United States Patent [19]

Higgins

[11] Patent Number: 4,745,974

[45] Date of Patent: May 24, 1988

[54] WELL TOOL LOCK MANDREL AND HANDLING TOOLS THEREFOR

[75] Inventor: Brian D. Higgins, Grand Prairie, Tex.

[73] Assignee: Otis Engineering Corporation, Dallas, Tex.

[21] Appl. No.: 945,028

[22] Filed: Dec. 22, 1986

[51] Int. Cl.[4] ..... E21B 23/02

[52] U.S. Cl. ..... 166/217; 166/125; 166/237

[58] Field of Search ..... 166/237, 217, 125, 182, 166/115

[56] References Cited

U.S. PATENT DOCUMENTS

| | | | |
|---|---|---|---|
| 3,507,329 | 4/1970 | Stone, Jr. | 166/217 X |
| 3,670,821 | 6/1972 | Tamplen | 166/217 X |
| 4,043,390 | 8/1977 | Glotin | 166/125 X |
| 4,457,368 | 7/1984 | Knierimen et al. | 166/217 |
| 4,479,539 | 10/1984 | Tamplen et al. | 166/237 X |
| 4,488,596 | 12/1984 | Akkerman | 166/217 |
| 4,545,434 | 10/1985 | Higgins | 166/217 |
| 4,595,054 | 6/1986 | Schroeder | 166/217 |

*Primary Examiner*—James A. Leppink
*Assistant Examiner*—Hoang C. Dang
*Attorney, Agent, or Firm*—H. Mathews Garland

[57] ABSTRACT

A well tool lock mandrel and running and pulling tools for installing and retrieving the lock mandrel. The lock mandrel is used for supporting a well tool such as a subsurface safety valve at a landing nipple in a well tubing string. The lock mandrel includes a tubular body, locking dogs supported in the body, an expander sleeve for operating the locking dogs, and a latch for releasably locking the expander sleeve when the locking dogs are locked outwardly. The running tool includes a head assembly for connection with a wireline tool string, an upper retainer key assembly for connection with the head of the lock mandrel, and a lower locking lug assembly for engagement with the expander sleeve of the lock mandrel for operating the sleeve. The running tool also includes a spring biased insertion sleeve for operating the lower locking lug assembly permitting the running tool to be installed in the lock mandrel when the locking dogs of the lock mandrel are at inward positions. The pulling tool including lugs for engaging the upper end of the lock mandrel expander sleeve to push it downwardly to a released position and a collet for engaging the head of the lock mandrel to retrieve the lock mandrel. An alternate form of the running tool permits use of the tool to set a lock mandrel which is larger in diameter than the well tool such as the safety valve supported from the lock mandrel.

21 Claims, 15 Drawing Sheets

WELL TOOL LOCK MANDREL AND HANDLING TOOLS THEREFOR

FIELD OF THE INVENTION

This invention relates to well tools and more particularly relates to a lock mandrel and running and pulling tools therefor for releasably locking a safety valve in the flow conductor of a well.

HISTORY OF THE PRIOR ART

In the well art, particularly that relating to oil and gas wells, it is standard practice to complete the wells using wireline equipment and methods which provides for substantial cost reductions during future well servicing operations. Wireline completion methods and equipment are illustrated and described in substantial detail in PETROLEUM ENGINEER INTERNATIONAL for August 1981 at pages 83–98. Presently available lock mandrels for sub-surface safety valves are of the extension hanger type, which may present several operational problems when used with safety valves. Extension hanger locks are set by applying force in the same downward direction required for driving the safety valve into the landing nipple in which the valve is to be locked. The friction caused by packing between the safety valve and the landing nipple may require such excessive drive-down force that the lock mandrel is prematurely set. Further, it is possible to only partly engage the lock mandrel in the recess, establish control line pressure, and remove the running tool used to set the lock mandrel without any indication of a serious problem. One remedy which has been employed is a spring isolator device, which eliminates major problems but still may malfunction. The locking sleeve of the extension hanger type lock must move in the opposite direction from flow to lock a safety valve. It is possible that flow could lift the locking sleeve releasing the lock.

Applicant's prior U.S. Pat. No. 4,545,434 issued Oct. 8, 1985 solves a substantial number of the problems encountered in the prior art devices. Such patent shows a lock mandrel and running tool similar to the present devices. A lock mandrel set by downward force and released by upward pulling is shown in U.S. Pat. No. 4,595,054 issued June 17, 1986. The present lock mandrel and handling tools offer several improved features over devices of the prior patent.

It is a principal object of the invention to provide new and improved well tools.

It is a particularly important object of the invention to provide a new and improved lock mandrel and running and pulling tools for such lock mandrel for use in wells to releasably lock devices such as safety valves at a landing nipple along a flow conductor of a well.

It is another object of the invention to provide a well lock mandrel and running tools operable with wireline equipment.

It is another object of the invention to provide a running tool and a lock mandrel which is set by a force applied in a direction opposite to the direction of force required to drive the device such as a safety valve connected with the lock mandrel into the landing nipple in which the lock mandrel is set.

It is another object of the invention to provide a running tool with a lock mandrel which may be driven downwardly with unlimited force without the possiblility of pre-setting the lock.

It is a further object of the invention to provide a running tool with a lock mandrel having a locking sleeve which moves to lock the mandrel in the direction of flow in the well thereby preventing well flow from releasing the lock.

It is a still further object of the invention to provide a running tool and a lock mandrel which requires that the lock mandrel be properly set and the well tool activated before the running tool can be released.

It is another object of the invention that safety valve control line integrity be established before the running tool can be released from the lock mandrel.

It is another object of the invention to provide a new and improved running tool for well apparatus such as a safety valve.

It is another object of the invention to provide a lock mandrel wherein the locking sleeves of the mandrel is releasably held at an upper end position at which the locking keys or dogs are expanded by a snap ring located above the keys.

It is another object of the invention to provide a lock mandrel for a well in which the locking sleeve is provided with an internal annular groove for engaging and moving the locking sleeve both downwardly and upwardly.

It is a further object of the invention to provide a lock mandrel which may be relocked without the need for a separate tool other than the running tool.

It is another object of the invention to provide a running tool which may be installed in the lock mandrel while the lock mandrel is in the unlocked position.

It is another object of the invention to provide a running tool having an adjustable core extension to permit use with numerous safety valves without separate hardware.

It is another object of the invention to provide a lock mandrel which includes elastomer rings at the upper and lower ends of the lock sleeve to dampen any vibration between the lock sleeve and the remaining structure of the lock mandrel.

SUMMARY OF THE INVENTION

In accordance with the invention there are provided a lock mandrel for releasably locking a well device at a landing nipple in a flow conductor and running and pulling tools for setting and removing the lock mandrel. The lock mandrel includes a tubular body, circumerentially spaced locking dogs or keys for radial movement between lock and release positions, a key expander sleeve movable upwardly behind the keys for expanding the lock keys outwardly including an internal annular recess in the sleeve for engagement by running tools to move the sleeve both upwardly and downwardly, an annular locking boss around the upper end portion of the sleeve, and a snap ring within the body above the keys for releasably locking the sleeve at an upper key expanded position. The running tool includes a head assembly for supporting the tool in a well from a wireline tool string, an upper latch assembly including retainer dogs for releasably engaging the lock mandrel body, a lower latch assembly for engaging the expander sleeve of the lock mandrel including a spring biased insertion sleeve and expandable locking lugs mounted on a central core supported from the head assembly, and an operating prong secured in the lower end of the core including an adjustable core extension for fitting the running tool to a variety of safety valves. The pulling tool has a head assembly for securing with a wireline tool string, a central core extendable into the lock mandrel, collet fingers on the head assembly for engaging the pulling neck of the lock mandrel body, and radially expandable unlocking lugs extendable from the core for engaging the upper end of the lock mandrel expander sleeve to drive the sleeve back downwardly for releasing the lock mandrel keys. In operation the running tool is inserted into the lock mandrel with the locking dogs in the unlocked position and the head of the running tool is attached to a wireline tool string. The safety valve is pumped open during installation of the running tool in the lock mandrel and the safety valve is then released providing an upward bias on the core of the running tool. The safety valve and lock mandrel are lowered on the running tool by the wireline tool string through a flow conductor into the landing nipple at which the safety valve is to be locked. After the no-go shoulder on the lock mandrel body engages a no-go shoulder in the landing nipple, the safety valve is pumped open relieving the upward force on the running tool core and the running tool is then pulled upwardly expanding the keys of the lock mandrel. The locking lugs are then released from the locking sleeve freeing the running tool to be removed from the well. When pulling the lock mandrel, the pulling tool is lowered on a wireline tool string into the lock mandrel engaging the upper end of the locking sleeve of the mandrel driving the sleeve downwardly to release the locking keys of the mandrel. The collet fingers in the head of the pulling tool engage the pulling neck of the mandrel pulling the lock mandrel and safety valve upwardly in the flow conductor.

BRIEF DESCRIPTION OF THE DRAWING

The details of preferred embodiments of the invention together with its objects and advantages will be evident from the following description taken in conjunction with the accompanying drawings wherein.

DETAILED DESCRIPTION OF THE PREFERRED EMBODIMENT

Figure 1:
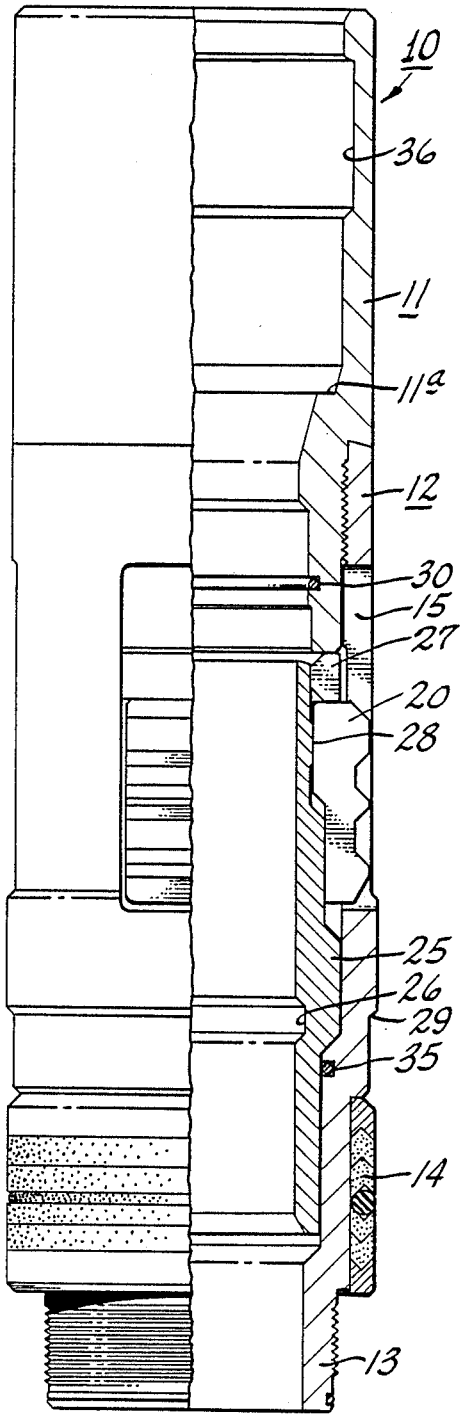
FIG. 1 is a longitudinal view in section and elevation of a lock mandrel embodying the features of the invention.
Figure 7A:
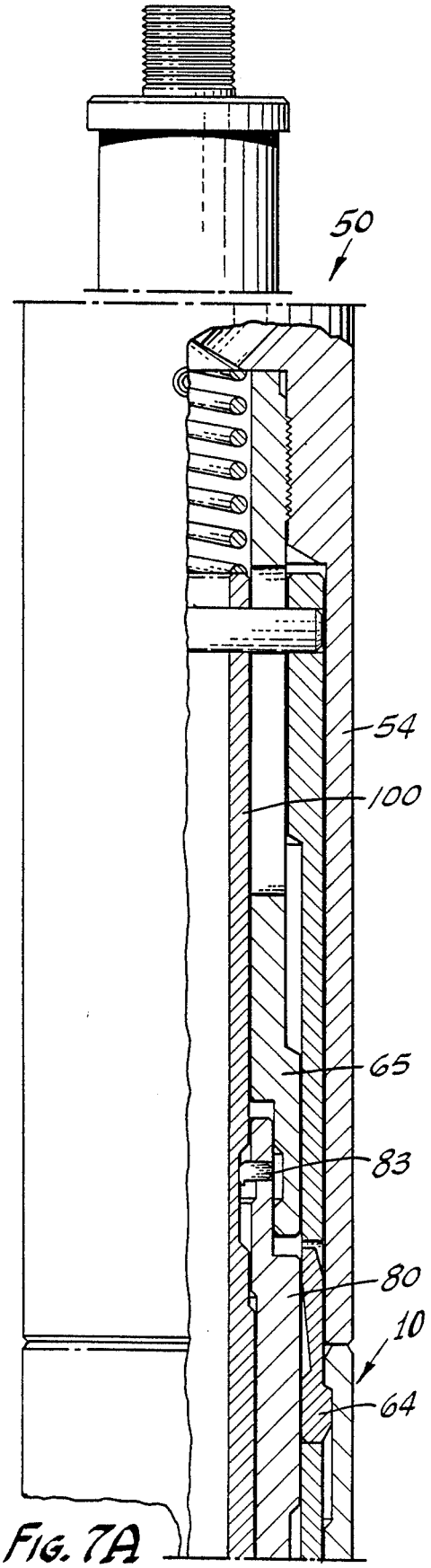
FIGS. 7A and 7B form a schematic view in section illustrating the running tool fully coupled with the lock mandrel and safety valve with the pressure released on the safety valve after installation.
Figure 7B:
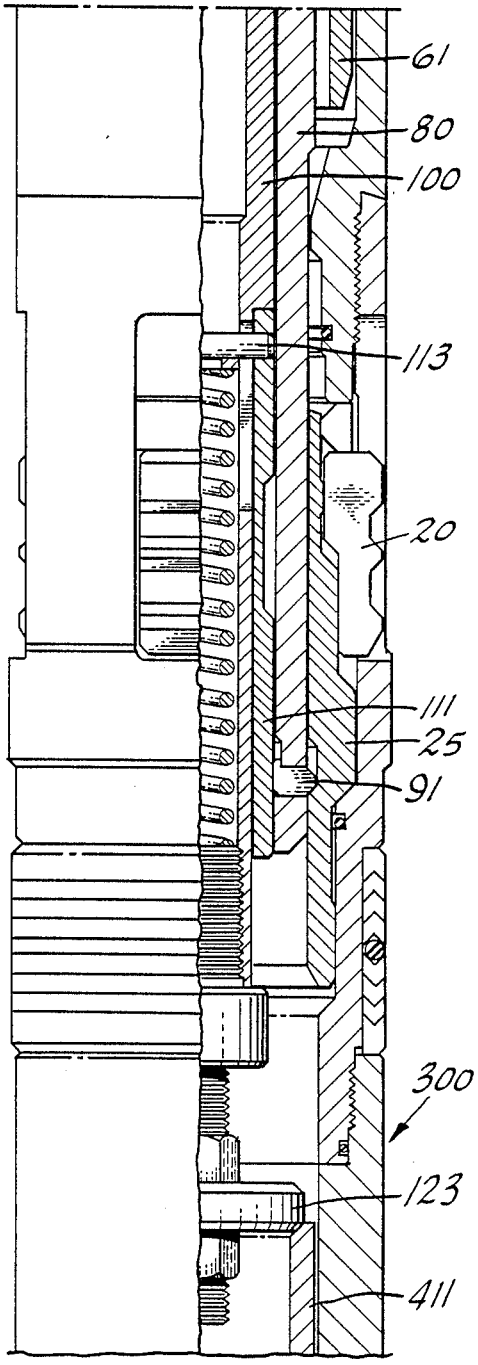

Referring to FIG. 1, the lock mandrel 10 of the invention has a tubular body formed by a head 11 and a packing mandrel and locking dog retainer sleeve 12. The sleeve 12 is threaded at the upper end on the head 11 and has a graduated lower end portion 13 which is externally threaded and supports an annular packing assembly 14 for sealing around the lock mandrel in a landing nipple. The sleeve 12 is provided with longitudinal circumferentially spaced windows 15 in which radially expandable locking dogs 20 are fitted. In accordance with standard well tool design, the locking dogs 20 have side ears fitting behind longitudinal flanges along the windows 15, not shown, retaining the locking dogs in the windows. Such structure is shown in detail in U.S. Pat. No. 4,545,434, particularly in FIGS. 3 and 7. A locking dog expander sleeve 25 is mounted for longitudinal movement within the bore of the sleeve 12 within the locking dogs 20 for expanding the dogs radially through the windows 15. The expander sleeve has a stepped outer surface conforming to the internal surfaces of the locking dogs 20 for expanding the dogs and holding them outwardly in the windows 15 for locking the lock mandrel at a landing nipple. The expander sleeve 25 has an internal annular operating recess 26 for engagement by operating lugs on the running tool to move the expander sleeve upwardly and downwardly. A split snap ring 27 is fitted within the sleeve 12 above the dogs 20 for engagement with an external annular latch boss 28 on the expander sleeve 25 when the expander sleeve is at an upper end position at which the dogs 20 are expanded. The coaction between the ring 27 and the latch boss 28 releasably holds the expander sleeve 25 at the upper locking position at which the dogs 20 are fully expanded locking the lock mandrel in a landing nipple. The sleeve 12 has an external annular no-go shoulder 29 which seats on a stop shoulder in the landing nipple when the lock mandrel is installed in the landing nipple. Annular seals 30 and 35 are fitted within the head 11 and the sleeve 12, respectively, for sealing with the outer surface of the expander sleeve 25. The head 11 has an internal annular recess 36 for engagement by the running tool and the pulling tool during installation and removal of the lock mandrel.

Figure 2A:
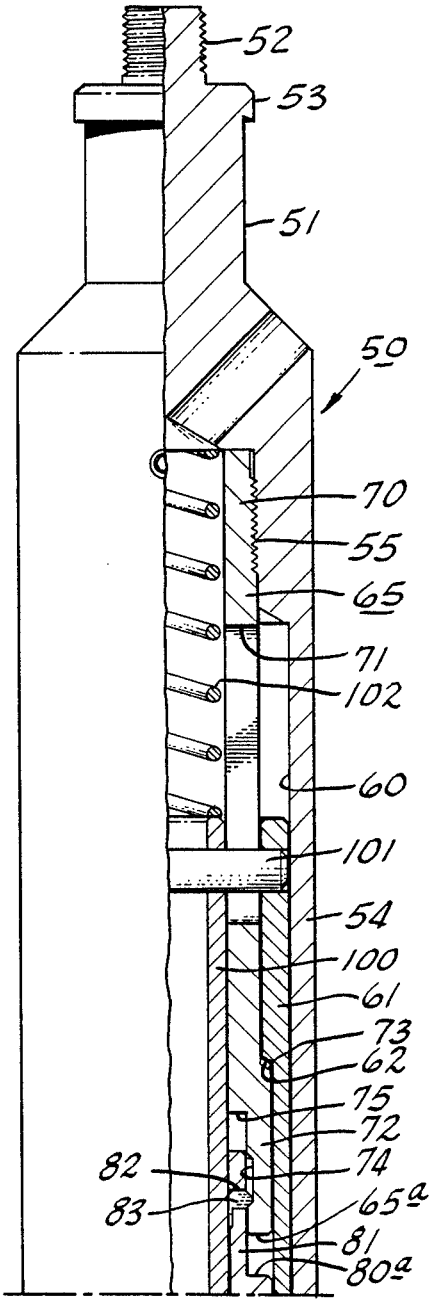
FIGS. 2A and 2B taken together are a longitudinal view in section and elevation of a running tool for installing the lock mandrel of FIG. 1 in a.well flow conductor landing nipple.
Figure 2B:
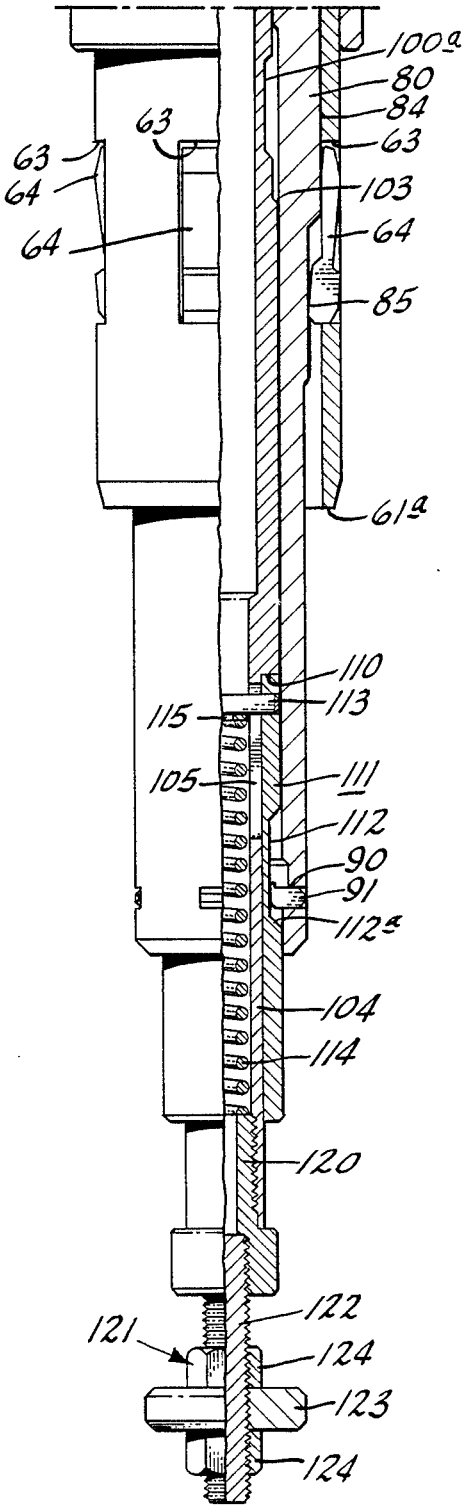

Referring to FIGS. 2A and 2B, the running tool 50 used for installation of the lock mandrel 10 has a fishing neck 51 provided with standard wireline features for connection in a wireline tool string, not shown. The neck 51 includes a reduced threaded upper end portion 52 and an external annular flange 53. The fishing neck has a skirt portion 54 and is provided with a graduated bore having an upper internally threaded section 55 and an enlarged downwardly opening section 60. A retainer dog sleeve 61 telescopes into the fishing neck skirt 54 and is provided with a downwardly facing internal annular shoulder 62 and circumferentially spaced retainer dog windows 63 for radially expandable retainer dogs 64. The windows 63 each have retaining flanges or ears which hold the dogs in the windows while permitting them to expand and contract radially, as illustrated in detail in FIGS. 11–16 or U.S. Pat. No. 4,545,434. The retainer dogs function to releasably couple the running tool with the head of the lock mandrel during installation of the lock mandrel. An upper setting sleeve 65 is fitted in concentric space relation within the retainer sleeve 61. The sleeve 65 has a reduced threaded upper end portion 70 which engages the threads 55 of the fishing neck. The upper setting sleeve 65 has longitudinal slots 71 along each side of the sleeve and an enlarged lower end portion 72 providing an upwardly facing external annular shoulder 73. The enlarged sleeve portion 72 has a downwardly opening enlarged bore portion provided with an internal annular latch recess 74. The lower enlarged bore portion of the sleeve 72 is also provided with an internal annular downwardly facing stop shoulder 75. A lower setting sleeve 80 is slidably fitted within the key retainer sleeve 61 and has a reduced upper end portion 81 which telescopes into the lower end of the bore of the upper setting sleeve 65. The lower setting sleeve upper end portion has circumferentially spaced windows 82 in which transfer lugs 83 are fitted for radial movement for releasing and engaging the upper setting sleeve latch recess 74. As shown in FIG. 2A, the transfer lugs 83 are expandable to positions at which the outer bosses of the lugs engage the recess 74 of the upper setting sleeve. The central portion of the lower setting sleeve has a graduated outer surface providing an upper external annular locking surface 84 and a central external annular release surface 85. The surfaces 84 and 85 coact with the inner surfaces of the retainer dogs 64 for holding the dogs outwardly in lock positions and permitting the dogs retract inwardly to release positions, as shown in FIG. 2A. The lower end portion of the lower setting sleeve 80 has circumferentially spaced windows 90 in which locking lugs 91 are positioned which coact with the expander sleeve 25 of the lock mandrel when setting the lock mandrel in a landing nipple. A tubular core 100 is positioned through the lower setting sleeve 80 extending upwardly into a portion of the upper setting sleeve 65 where the core is secured by a pin 101 to the retainer sleeve 61. The pin 101 passes through the longitudinal slots 71 in the upper setting sleeve 65, as shown in FIG. 2A. A spring 102 is compressed within the fishing neck bore between the upper end of the bore and the upper end of the core biasing the core downwardly. The core has an external annular transfer lug release recess **100*a*. A stop shoulder 103 on the core below the release recess 100*a* is engageable with the reduced head portion 81 of the lower setting sleeve 80 during a step in the operation of the running tool. The core 100 is reduced along a lower end portion 104 which is provided with longitudinal oppositely disposed slots 105. An external annular stop shoulder 110 is provided on the core at the upper end of the reduced lower end section 104. An insertion sleeve 111 is slidably mounted on the reduced lower end portion 104 of the core. The insertion sleeve as an external annular release recess 112 which coacts with the locking lugs 91 to permit the locking lugs to move inwardly to release positions, as shown in FIG. 2B. The insertion sleeve is held on the core by a pin 113 extending through the slots 105 in the core. A spring 114 within the bore of the core is compressed between a washer 115 at the upper end of the spring bearing against the pin 113 and the upper end edge of a core nut 120 threaded into the lower end of the core. The spring 114 acting through the pin 113 biases the insertion sleeve 111 to the upper end position on the core illustrated in FIG. 2B. An adjustable core extension assembly 121 is secured into the lower end of the core nut 120. The extension assembly includes a threaded rod 122 and an internally threaded annular stop plate 123 locked on the rod 122 by identical nuts 124. The stop plate 123 is engageable with the upper end of the operating piston of a safety valve and is adjustable along the length of the rod 122 to accommodate the running tool to a variety of safety valve designs. As explained in more detail hereinafter, the spring biased insertion sleeve 111 coacts with the locking lugs 91** during the installation of the lock mandrel with the running tool and permits the running tool to be installed in the lock mandrel when lock mandrel is in the unlocked condition.

Figure 15A:
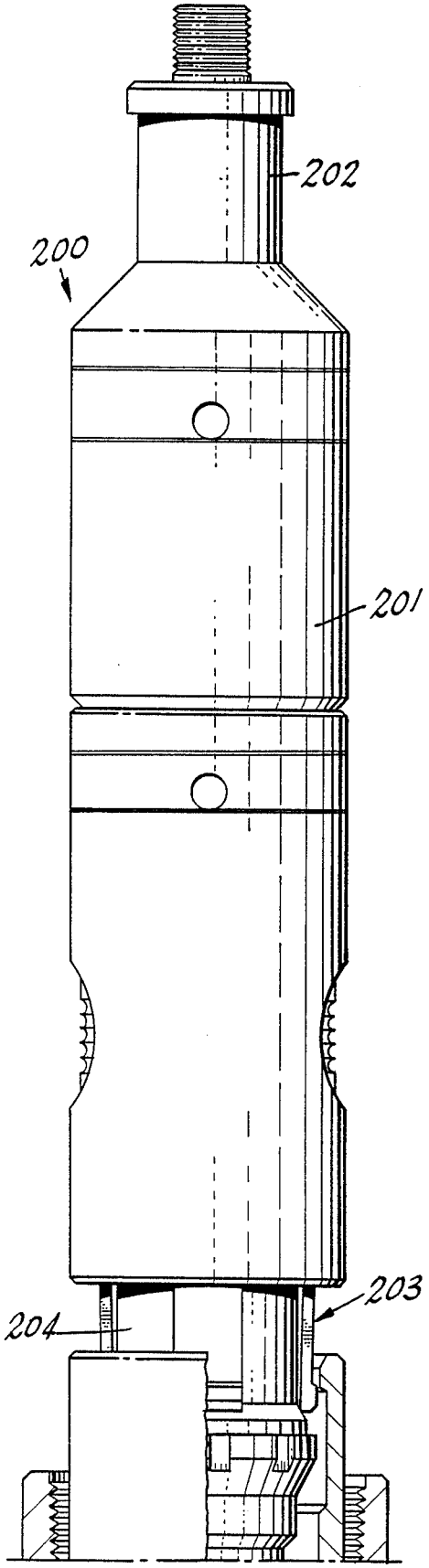
FIGS. 15A and 15B form a longitudinal view in section and elevation of the pulling tool of the invention inserted into the lock mandrel in the landing nipple and the locking keys of the lock mandrel retracted.
Figure 15B:
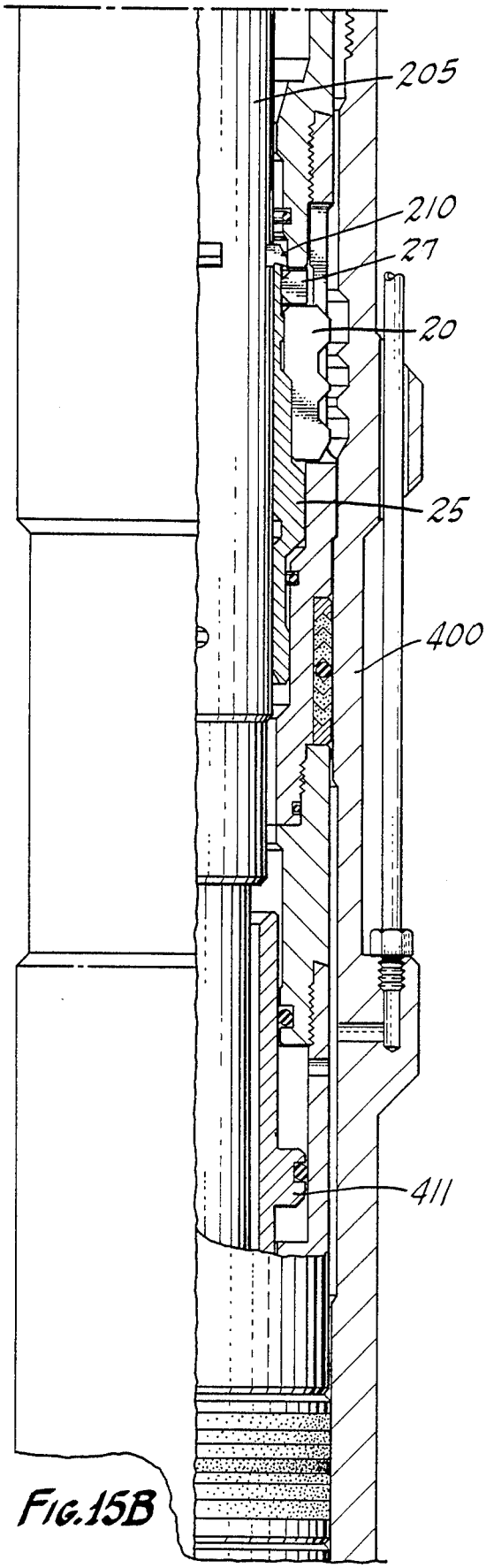

Referring to FIGS. 15A and 15B, a pulling tool 200 for removing the lock mandrel and safety valve includes a head 201 having fishing neck 202 for connection with a wireline tool string. A pulling collet 203 is supported from the head for engagement with the recess 36 in the head 11 of the lock mandrel. The collet 203 is movable on an expander mandrel 204 supported from the head for holding the collet 203 expanded and for releasing the collet for compression inwardly. An operating prong or core 205 extends downwardly from the head and supports radially expandable unlocking lugs 210 which are engageable with the upper end edge of the expander sleeve 25 of the lock mandrel to drive the expander sleeve downwardly for releasing the dogs 20.

Figure 8A:
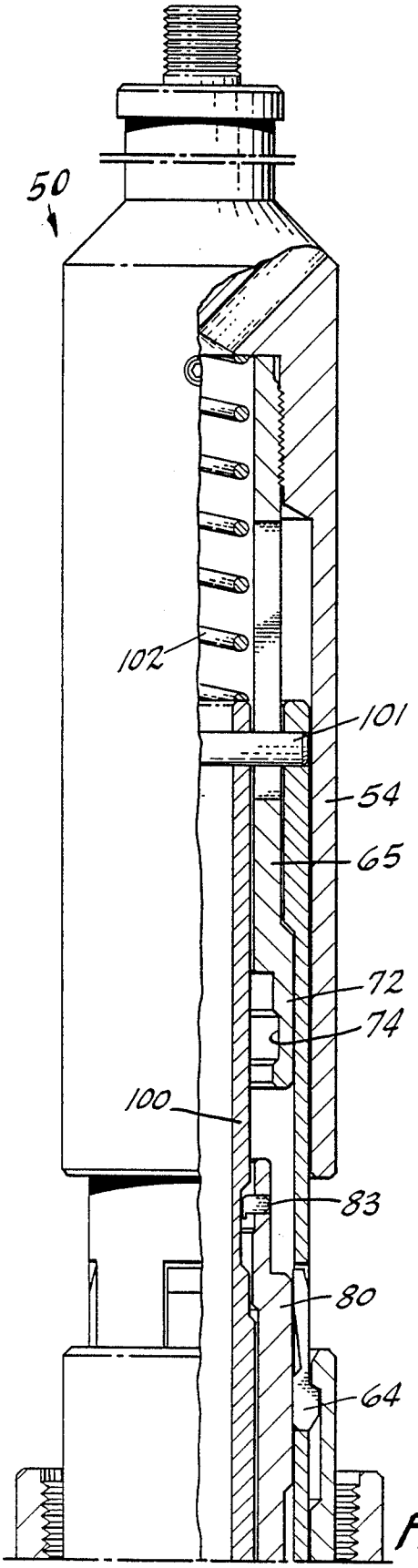
FIGS. 8A and 8B together form a view in section and elevation of the running tool and lock mandrel positioned as suspended from a wireline tool string in the landing nipple of a well flow conductor in which the lock mandrel is being installed.
Figure 8B:
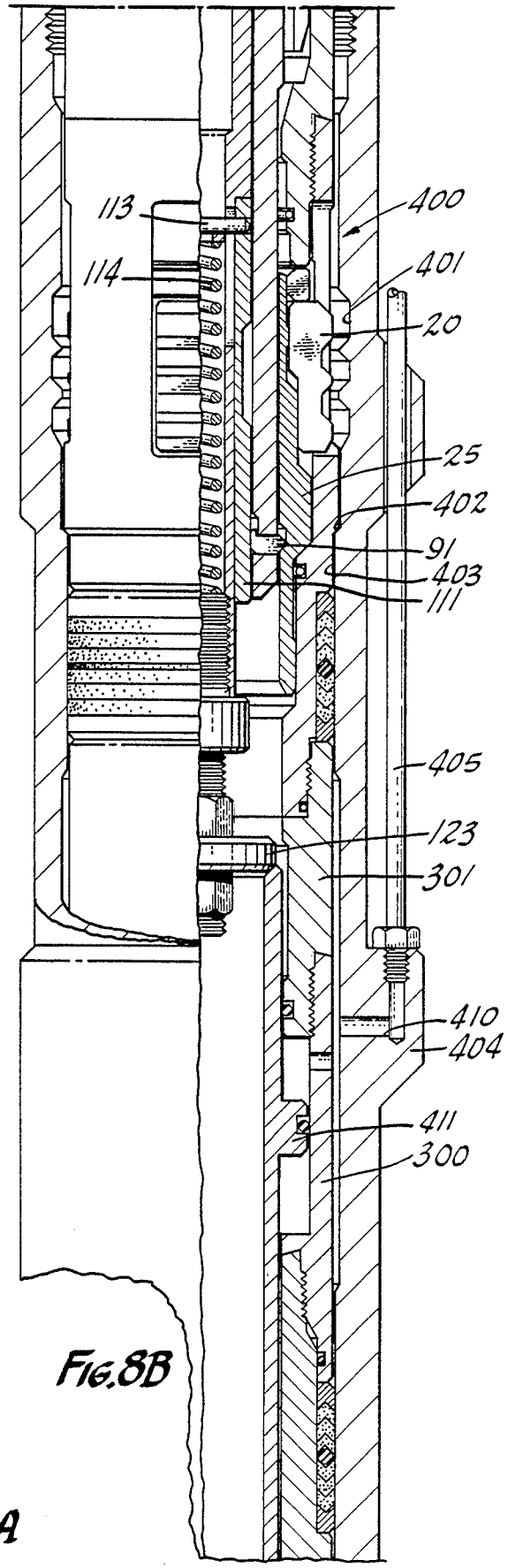

The first step in the installation of the lock mandrel 10 is the connection of the lock mandrel with a subsurface safety valve 300 by threading the lower reduced threaded end portion 13 of the lock mandrel housing into the upper end portion 301 of the safety valve 300. The lock mandrel and safety valve are then installed on the running tool 50 for running the safety valve in a well flow conductor into a landing nipple 400, as best illustrated in FIGS. 8A and 8B. The landing nipple 400 is a conventional landing nipple connected in the flow conductor, not shown, of a well, in accordance with standard procedure. The landing nipple includes an internal locking recess profile 401 which is designed to receive the locking dogs 20 of the lock mandrel 10. Below the locking dog recess 401, the landing nipple has an internal annular no-go shoulder 402 which is engageable by the stop shoulder 29 on the lock mandrel body. The landing nipple has a seal surface 403 below the no-go shoulder for engagement by the seal assembly 14 on the lock mandrel. The landing nipple has a side fluid fitting 404 connected with a control fluid line 405 leading to a side port 410 in the landing nipple for conducting control fluid from the surface end of a well through the line 405 into the landing nipple to control the operation of an annular piston 411 of the safety valve 300 in accordance with standard safety valve procedure.

Figure 3A:
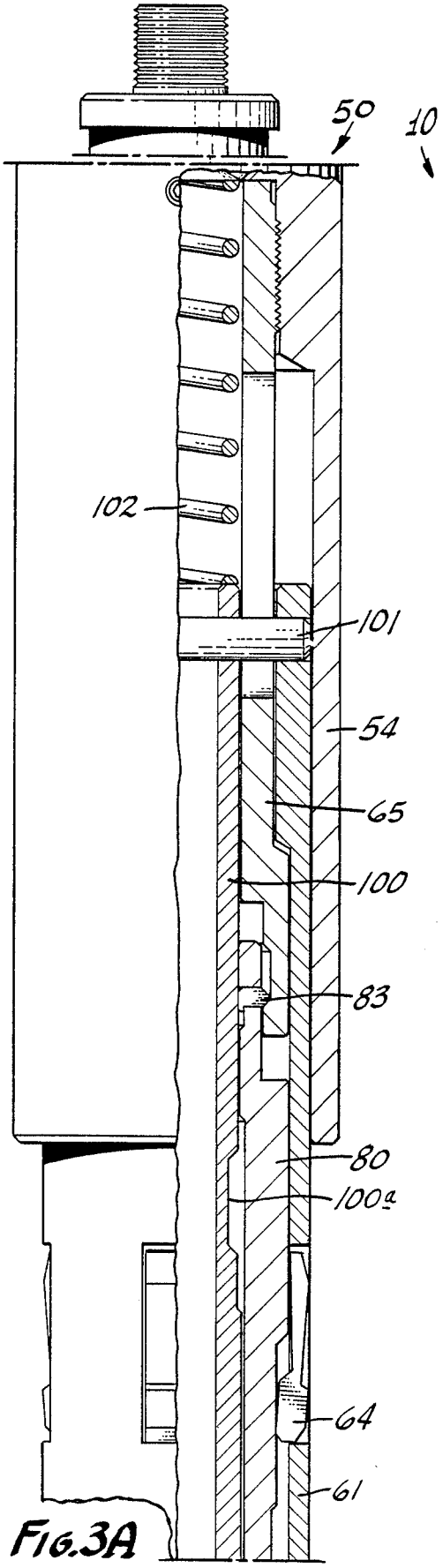
FIGS. 3A and 3B form a schematic longitudinal view in section illustrating a first step in the installation of the running tool in the lock mandrel.
Figure 3B:
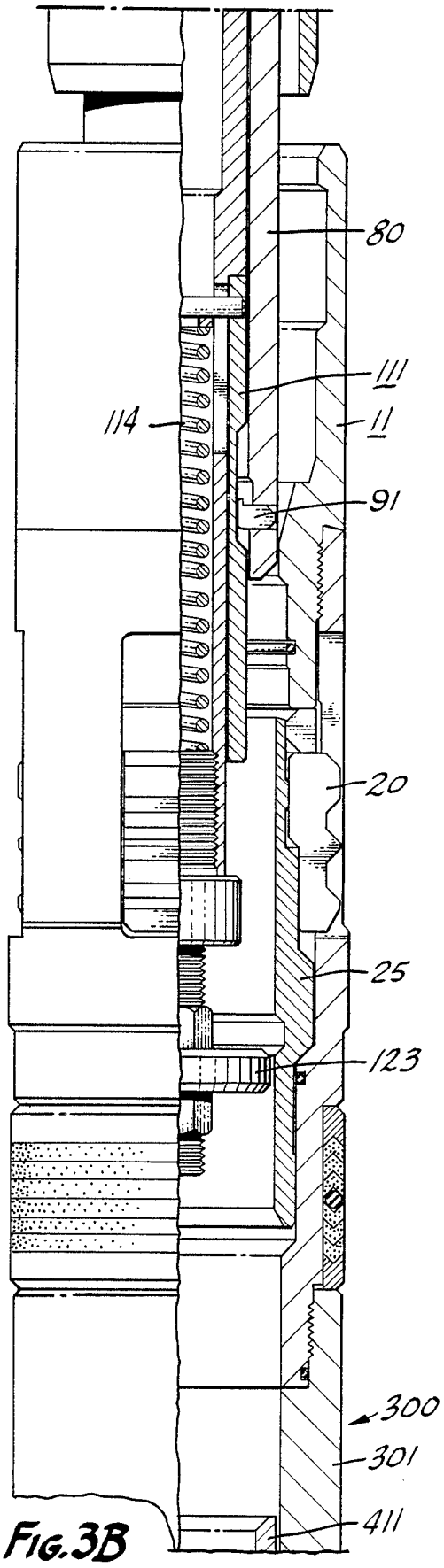
Figure 4A:
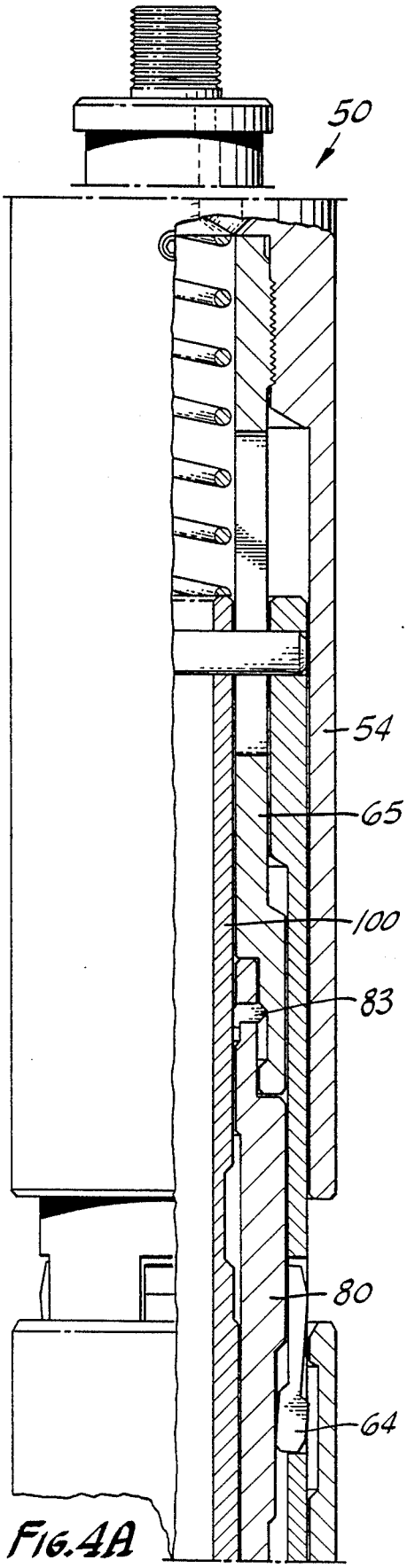
FIGS. 4A and 4B form a schematic longitudinal view in section showing a second step in the installation of the running tool in the lock mandrel.
Figure 4B:
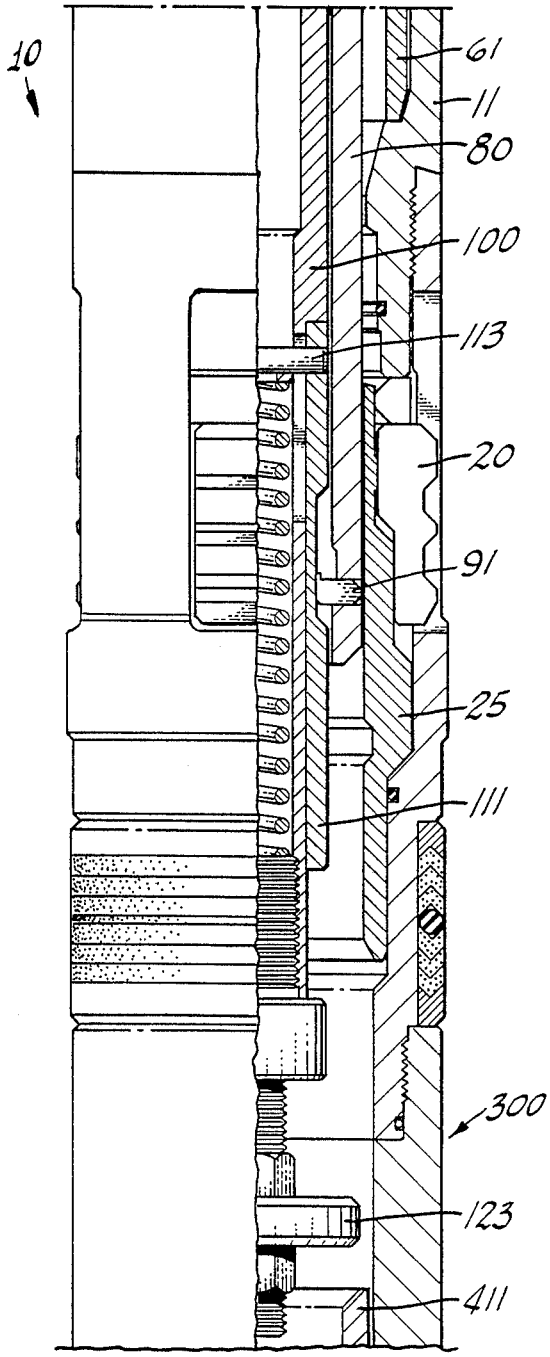
Figure 5A:
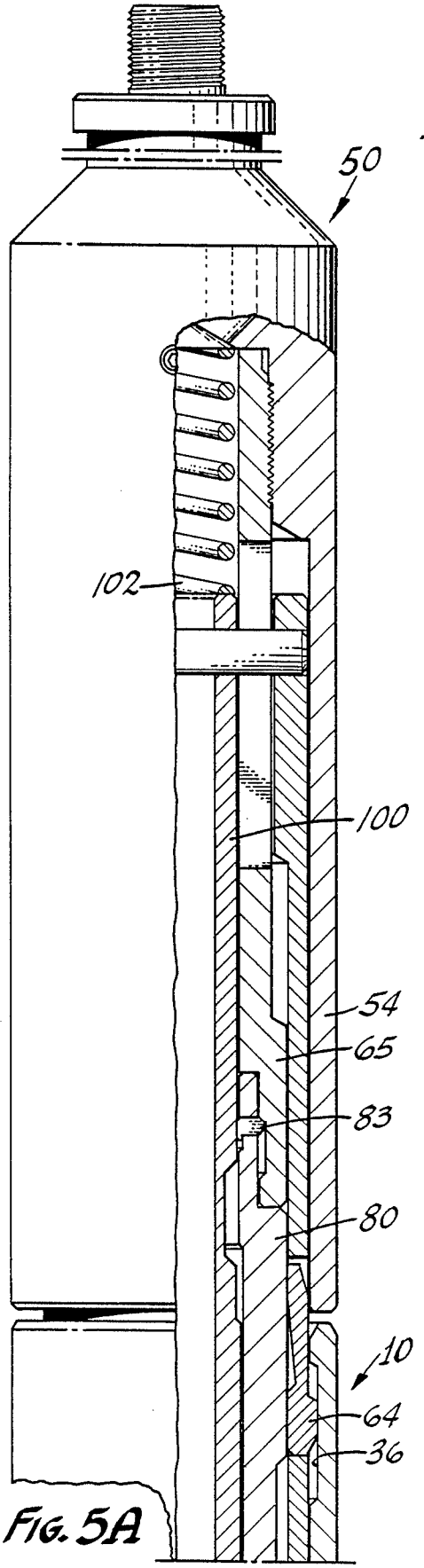
FIGS. 5A and 5B together form a schematic view in section showing a third step in the installation of the running tool in the lock mandrel.
Figure 5B:
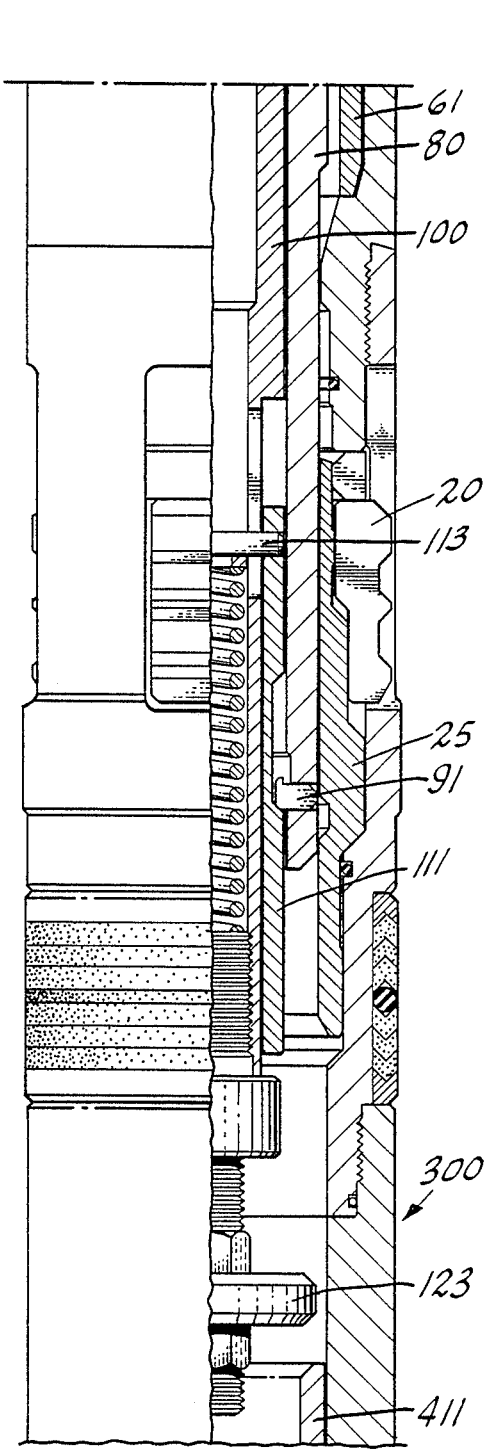
Figure 6A:
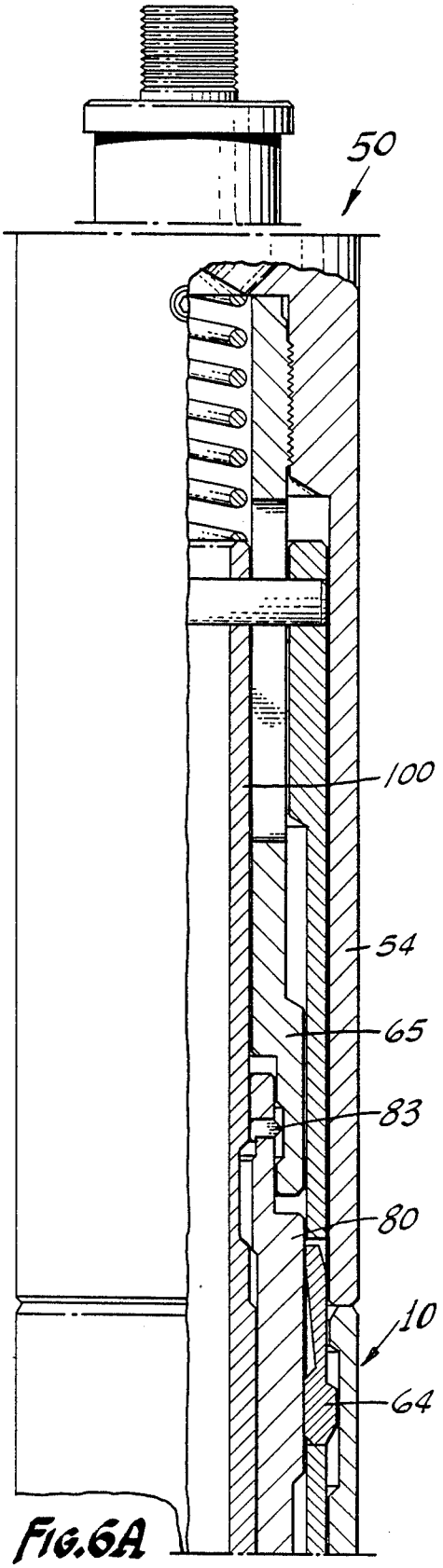
FIGS. 6A and 6B together form a schematic view in section showing the running tool completely installed in the lock mandrel.
Figure 6B:
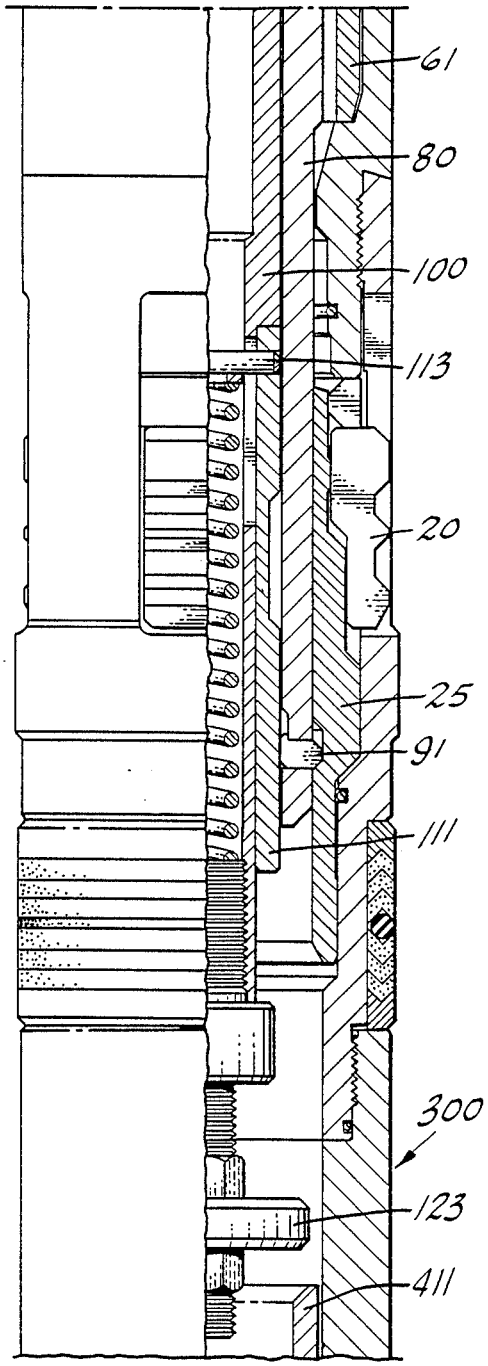

The installation of the running tool 50 in the lock mandrel 10 is illustrated sequentially in FIGS. 3A and 3B through FIGS. 8A and 8B. The running tool 50 is inserted into the assembled lock mandrel 10 and safety valve 300 in the condition of the running tool represented in FIGS. 2A and 2B. The spring 114 within the core is biasing the insertion sleeve 111 to the upper end position illustrated in FIG. 2B at which the lugs 91 may retract inwardly into the insertion sleeve recess 112 to the release positions so that the lugs may be freely introduced into the lock mandrel bore. The spring 102, as shown in FIG. 2A, urges the core 100 to a lower end position at which the transfer lugs 83 are held outwardly into the recess 74 of the upper setting sleeve 65. The release surface 85 on the lower setting sleeve 80 is within the retainer dogs 64 so that the dogs 64 are at inward release positions for insertion into the recess 36 of the head 11 of the lock mandrel 10. FIGS. 3A and 3B show the running tool inserted into the lock mandrel reduced central bore portion to location at which the locking lugs 91 are entering the central reduced bore portion of the lock mandrel body above the seal 30. As the running tool is inserted farther downwardly into the lock mandrel as shown in FIGS. 4A and 4B, the locking lugs 91 enter the bore of the lock mandrel expander sleeve 25 and the retainer dogs 64 enter the head 11 of the lock mandrel 10 aligned within the internal annular recess 36 of the lock mandrel head. At the position shown in FIGS. 4A and 4B, the lower end edge of 61*a* of the running tool sleeve 61 is engaged with the internal annular stop shoulder 11*a* of the head of the lock mandrel 10. With the sleeve 61 restrained against further movement into the lock mandrel body the connection of the pin 101 between the sleeve 61 and the core 100 prevents any further downward movement of the core into the lock mandrel. Additional downward force applied to the running tool head telescopes the head downwardly on the sleeve 61 and the core 100 simultaneously moving the upper setting sleeve 65, which is screwed into the running tool head, downwardly until the lower end edge 65*a* of the upper setting sleeve engages the upwardly facing stop shoulder 80*a* on the lower setting sleeve 80, as also represented in FIGS. 4A and 4B. Additional downward force on the running tool head further compresses the spring 102 and the upper and lower setting sleeves 65 and 80 which are now telescoped together move downwardly on the core carrying the insertion sleeve 111 downwardly because the locking lugs 91 extend into the insertion sleeve recess 112 and are held inwardly by the bore surface of the lock mandrel expander sleeve 25. The lugs 91 engage the lower end surface 112*a* of the recess 112 on the insertion sleeve forcing the insertion sleeve downwardly with the upper and lower setting sleeves on the core compressing the spring 114. This additional downward movement of the setting sleeves and insertion sleeve 111 is represented in FIGS. 5A and 5B which show the insertion sleeve downward and the lugs 91 fully within the bore of the lock mandrel sleeve 25 just before the lugs move into an alignment with the recess 26 in the sleeve 25. The downward movement of the upper and lower setting sleeves of the running tool, in addition to carrying the insertion sleeve 111 downwardly, moved the retainer dog holding surface 84 on the lower setting sleeve 80 behind the retainer dogs 64. When the lower retainer sleeve release surface 85 moved below the retainer dogs to position the locking surface 84 within the dogs, the retainer dogs 64 were cammed outwardly into the recess 36 of the lock mandrel as shown in FIG. 5A. Thus, in the tool condition represented in FIGS. 5A and 5B, the running tool is telescoped to the condition illustrated with the retainer dogs 64 expanded and the locking lugs 91 about to reach alignment with the recess 26 of the expander sleeve 25 of the lock mandrel 10. At the instant that the insertion sleeve 111 is carried downwardly with the upper and lower setting sleeves aligning the lugs 91 with the recess 26, the upper bias of the spring 114 on the insertion sleeve through the pin 113 cams the locking lugs 91 outwardly into the recess 26 of the lock mandrel sleeve 25 out of the insertion sleeve recess 112. With the lugs 91 no longer holding the insertion sleeve downwardly against the spring 114, the spring returns the insertion sleeve back upwardly to the position represented in FIG. 6B, at which the outer surface of the insertion sleeve below the recess 112 holds the lugs 91 in the outward locking positions engaging the lock mandrel sleeve recess 26. During the installation of the running tool in the lock mandrel to this point the safety valve has been held open by pressure applied into the operating cylinder of the safety valve. In the condition represented in FIGS. 6A and 6B the core of the running tool with the adjustable core extension assembly 121 is at a lower end position. Release of the operating pressure in the safety valve permits the spring the safety valve, not shown, to urge the safety valve operating piston 411 upwardly engaging the stop plate 123 of the adjustable core extension. The upward force of the piston from the safety valve raises the core back upwardly lifting the pin 101 which pulls the retainer dog sleeve 61 upwardly engaging the dogs 64 with the upper end of the recess 36 in the head 11 of the lock mandrel 10, as represented in 7A and 7B. The upward movement of the core which expands the retainer dogs 64 also aligns the release recess 100*a* on the core within the transfer lugs 83 so that the transfer lugs may move inwardly disengaging the lugs from the upper setting sleeve recess 74 of the running tool. The head of running tool including the skirt 54 and the upper setting sleeve 65 is lifted upwardly due to the release by the transfer lugs 83 to the position shown in FIGS. 8A and 8B which is the condition of the running tool, lock mandrel, and safety valve as they hang from the wireline tool string for lowering in a well flow conductor. FIGS. 8A and 8B show such condition of the tools hanging from the wireline as they are lowered into the landing nipple 400. Since the upper setting sleeve 65 is disengaged from the lower setting sleeve 80, the lower setting sleeve stays at the lower end position illustrated in FIG. 8B at which the lock mandrel sleeve 25 is at the lower end position keeping the lock mandrel in the unlocked condition as it is lowered through the well flow conductor into the landing nipple to the position of FIG. 8B at which the stop shoulder 29 on the lock mandrel body engages and rests on the stop shoulder 402 in the landing nipple.

Figure 9A:
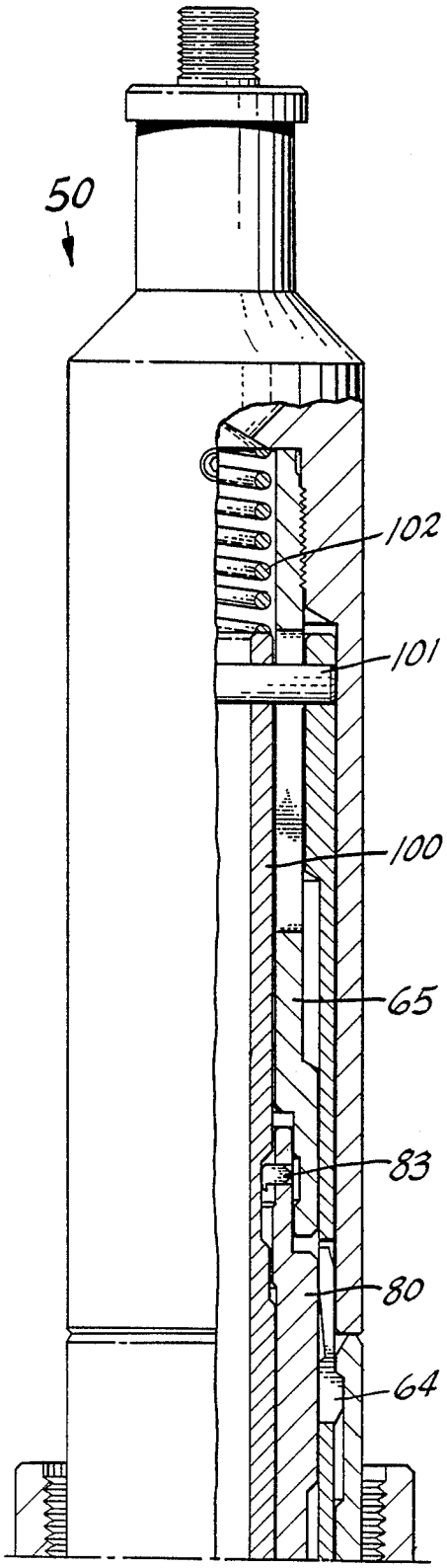
FIGS. 9A and 9B form a longitudinal view in section and elevation showing the lock mandrel on the no-go shoulder of the landing nipple and the running tool telescoped together preparatory to expanding the locking dogs of the lock mandrel.
Figure 9B:
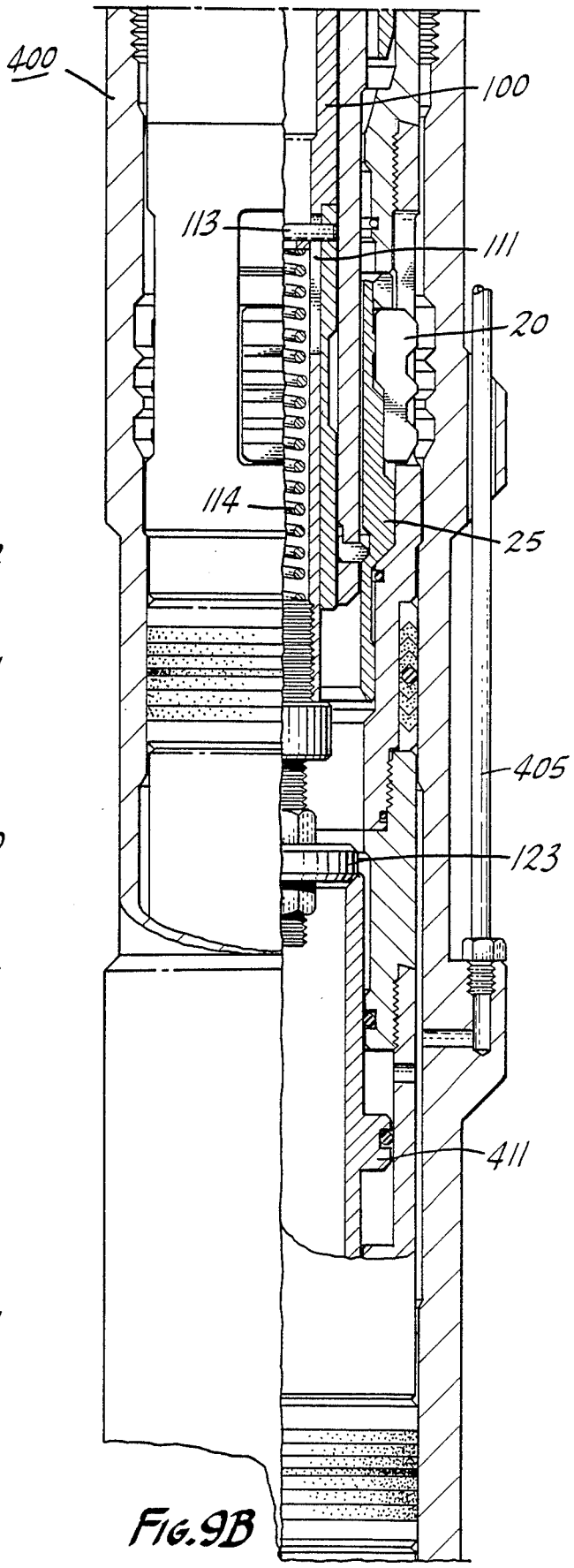
Figure 10A:
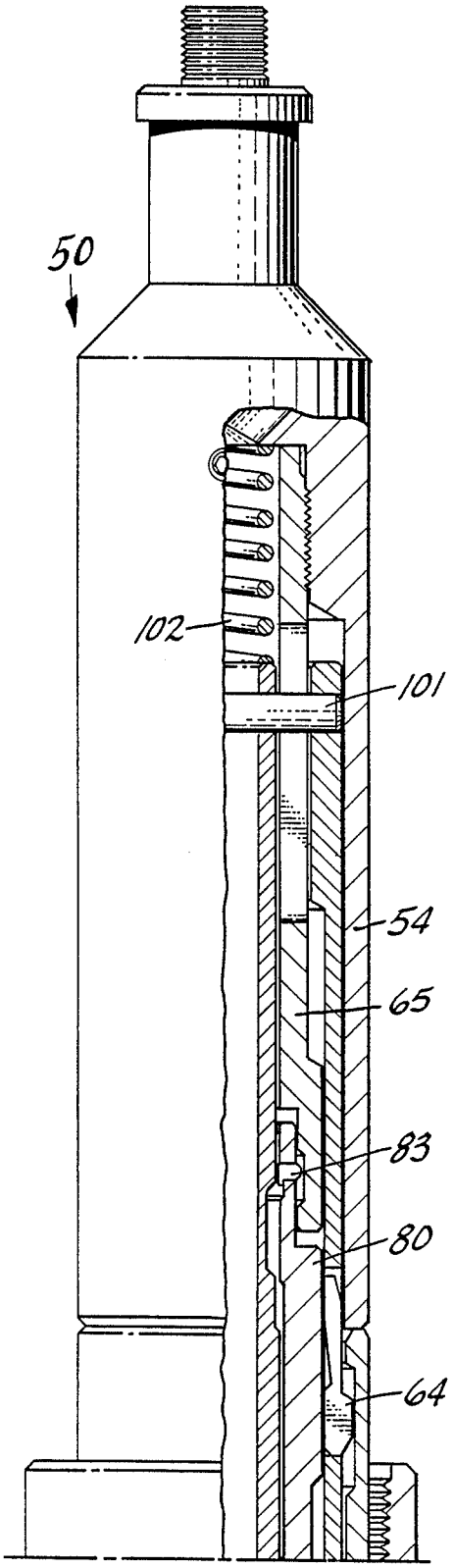
FIGS. 10A and 10B form a longitudinal view in section and elevation of the running tool and lock mandrel in the landing nipple with the safety valve pumped open relieving the upward force of the safety valve piston on the core of the running tool.
Figure 10B:
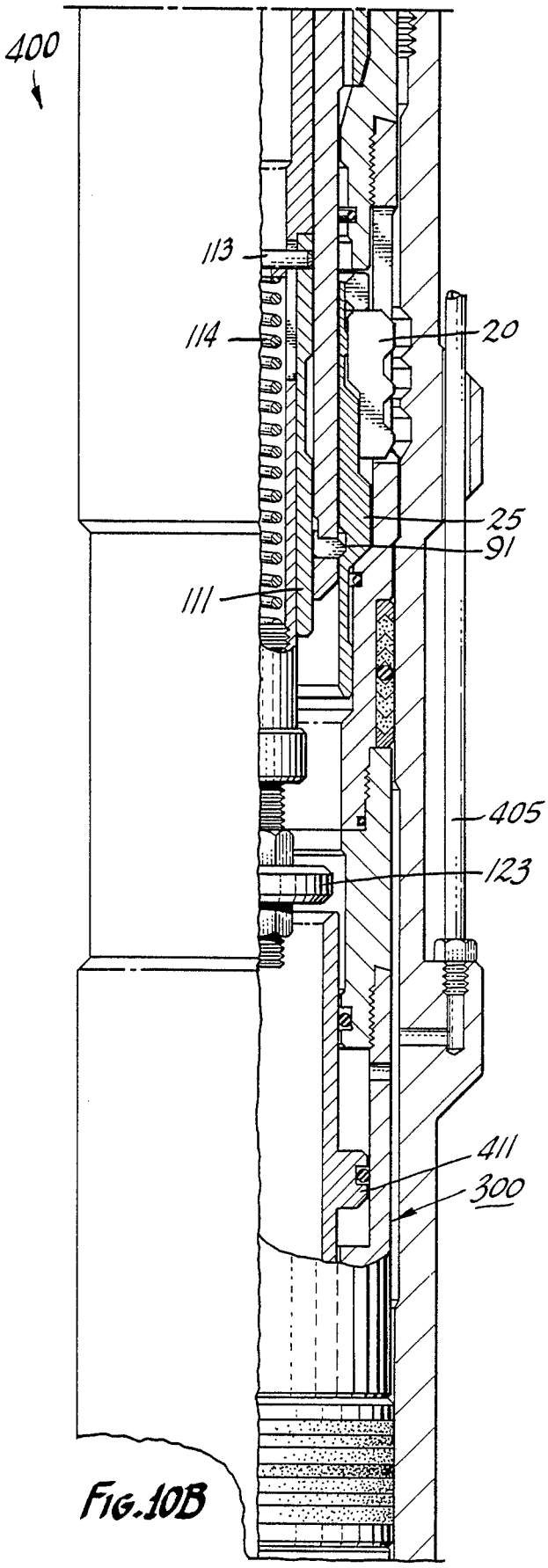
Figure 11A:
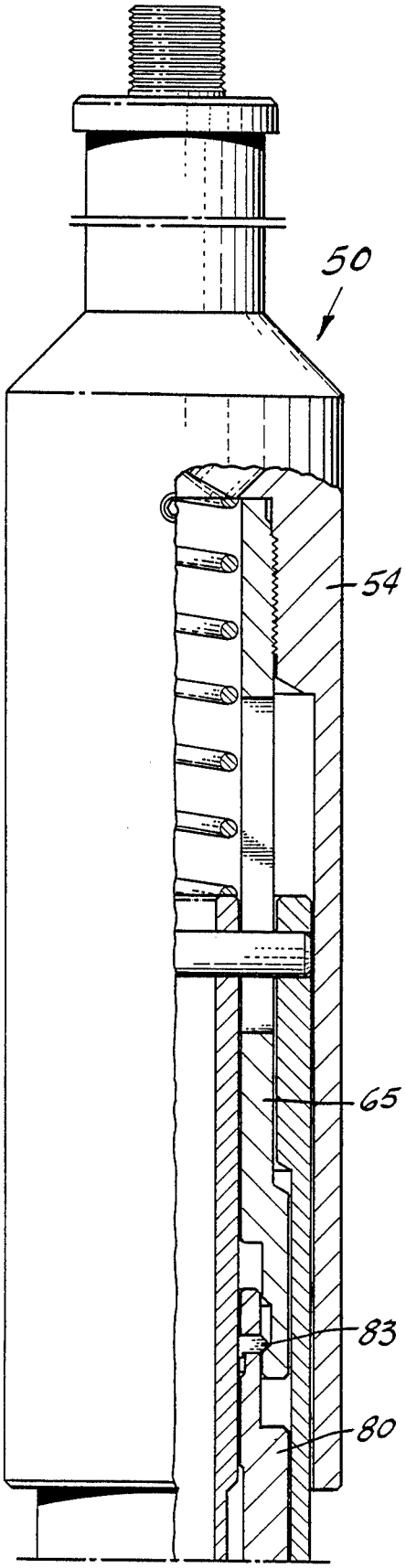
FIGS. 11A and 11B form a longitudinal schematic view in section of the running tool and lock mandrel as the locking lugs on the running tool are releasing from the lock mandrel.
Figure 11B:
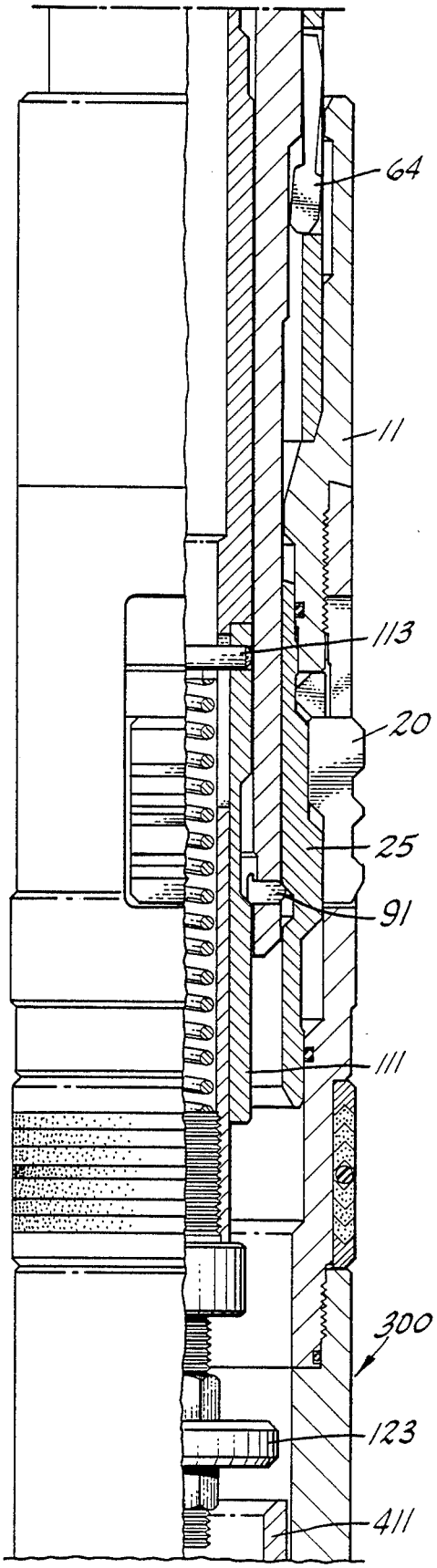
Figure 12A:
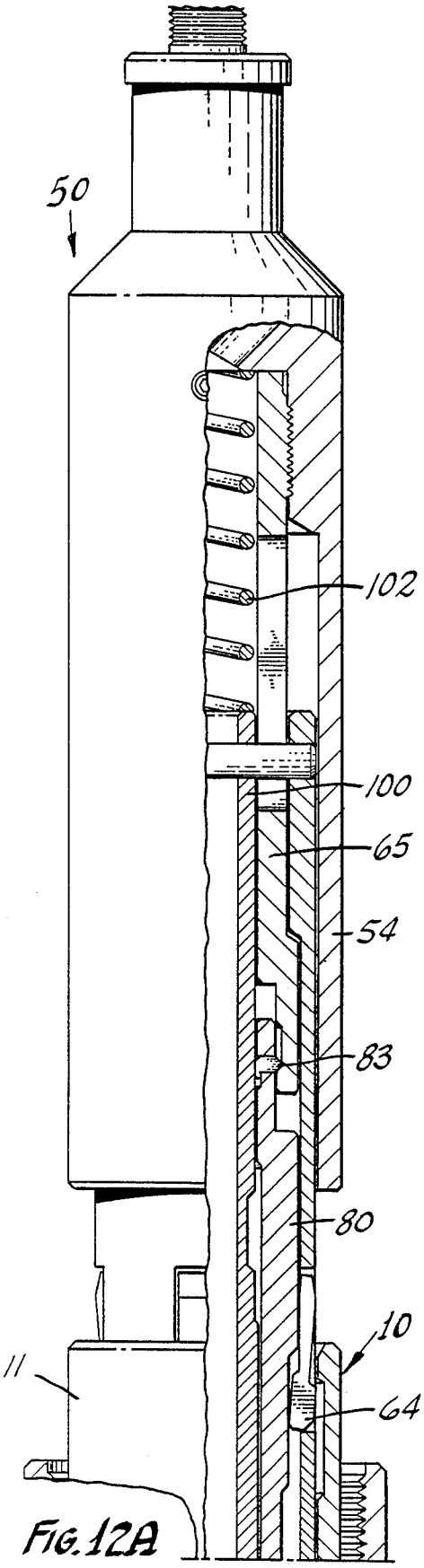
FIGS. 12A and 12B form a view in section and elevation of the running tool and lock mandrel with the locking dogs of the lock mandrel fully expanded and the locking lugs of the running tool fully released from the lock mandrel.
Figure 12B:
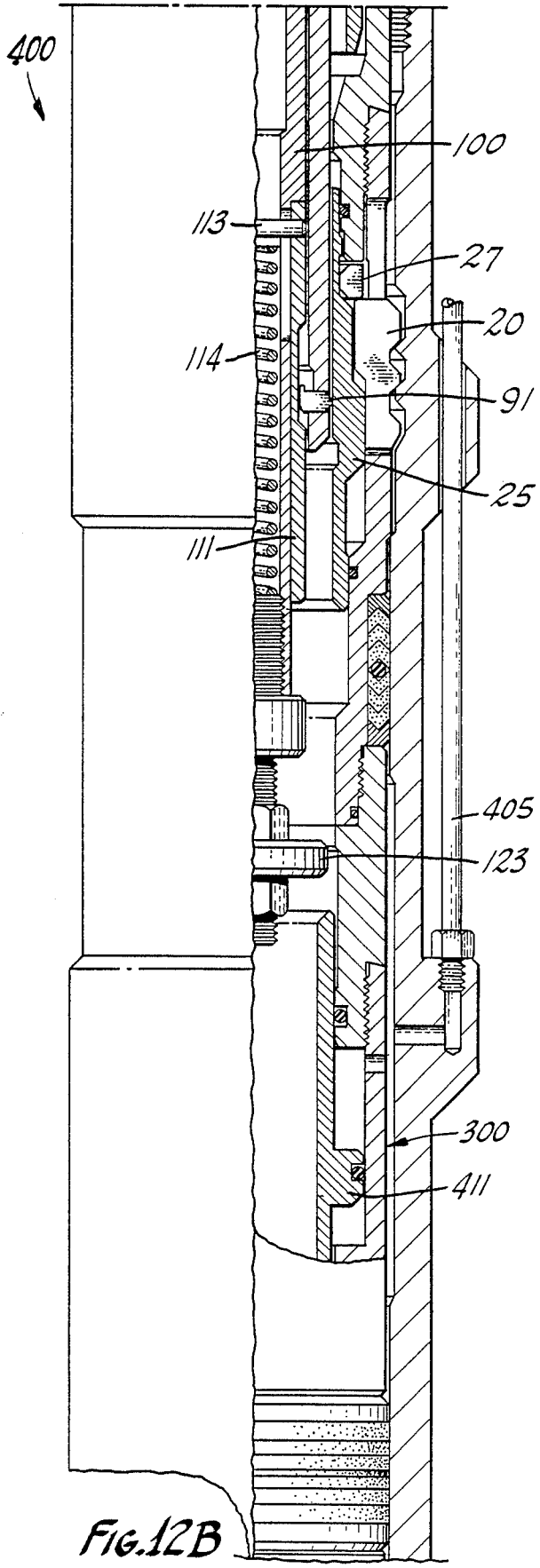

After the safety valve, lock mandrel, and running tool arrive in the landing nipple, as illustrated in FIGS. 8A and 8B, the wireline tool string is jarred downwardly telescoping the running tool to the condition shown in FIGS. 9A and 9B at which the head of the running tool moves downwardly until the lower end edge of the skirt 54 engages the upper end edge of the head 11 of the lock mandrel 10 and the lower enlarged end portion 72 of the upper setting sleeve moves over the transfer lugs 83 aligning the recess 74 in the upper setting sleeve with the transfer lugs. The safety valve is now in the proper position in the flow coductor below the landing nipple and the lock mandrel 10 is properly positioned in the landing nipple for expanding the locking dogs 20 of the lock mandrel. Control fluid pressure is applied from the surface through the control line 405 to the safety valve to pump the safety valve open moving the piston of the safety valve downwardly from the plate 123 on the adjustable core extension of the running tool. With the safety valve piston moved below the core extension plate 123, the core of the running tool is shifted by the spring 102 back downwardly until the lower end edge 61*a* of the retainer dog retaining sleeve 61, reengages the internal shoulder 11 in the lock mandrel head 11, as illustrated in FIGS. 10A and 10B. This downward movement also shifts the surface of the core above the recess 100*a* back behind the transfer lugs 83 as the upper setting sleeve 65 moves over the transfer lugs, that is, the recess 74 in the setting sleeve 65 is aligned with the transfer lugs. Simultaneously, the retainer dogs 64 are moved slightly below the upper end of the recess 36 in the head of the lock mandrel 10. This downward movement of the core cams the transfer lugs outwardly into the upper setting sleeve recess 74 and is caused by the force of the spring 102 which was permitted to expand due to the removal of the upward pressure on the core extension assembly by the safety valve piston which is now pumped open and no longer is urged upwardly against the core. An upward jarring force is then applied to the head of the running tool 50 by the wireline tool string telescoping the running tool to the extended condition represented in FIGS. 11A and 11B. Since the transfer lugs 83 are at outward positions, the upper setting sleeve 65 picks up the transfer lugs pulling them upwardly applying an upward force to the lower setting sleeve 80 which is pulled upwardly. The upward movement of the lower setting sleeve carries the locking lugs 91 upwardly due to the engagement of the lugs in the recess 26 of the lock mandrel expander sleeve 25. The expander sleeve is moved upwardly within the locking keys 20 of the lock mandrel expanding the locking keys 20 into the locking recess 401 of the landing nipple 400. FIG. 11B shows the locking dogs 20 of the lock mandrel 10 fully expanded into the locking recess of the landing nipple. The locking dogs 91 are now aligned with the recess 112 on the insertion sleeve 111. Continued upward force on the running tool head pulling the upper and lower setting sleeves upwardly causes the locking lugs 91 to be cammed inwardly from the recess 26 in the expander sleeve 25 of the lock mandrel into the insertion sleeve recess 112 so that the lugs 91 are released from the sleeve 25 leaving the expander sleeve 25 at the upper locking position. Simultaneously, the upward movement of the lower setting sleeve 80 of the running tool shifted the release surface 85 on the setting sleeve behind the retainer dogs 64 so that the dogs are free to cam inwardly for release from the recess 36 in the head of the lock mandrel 10, as shown in FIG. 11A. With the locking lugs 91 cammed inwardly out of the lock mandrel expander sleeve recess 26 and the retainer dogs 64 cammed inwardly out of the lock mandrel head recess 36, the running tool is fully released from the lock mandrel 10 leaving the lock mandrel in the locked condition in the landing nipple as shown in FIGS. 12A and 12B. Further upward movement of the tool string lifting the running tool extends the parts of the running tool to the condition shown in FIGS. 13A and 13B, at which the running tool is esentially extracted from the lock mandrel and may be lifted to the surface and removed from the well flow conductor.

Figure 14:
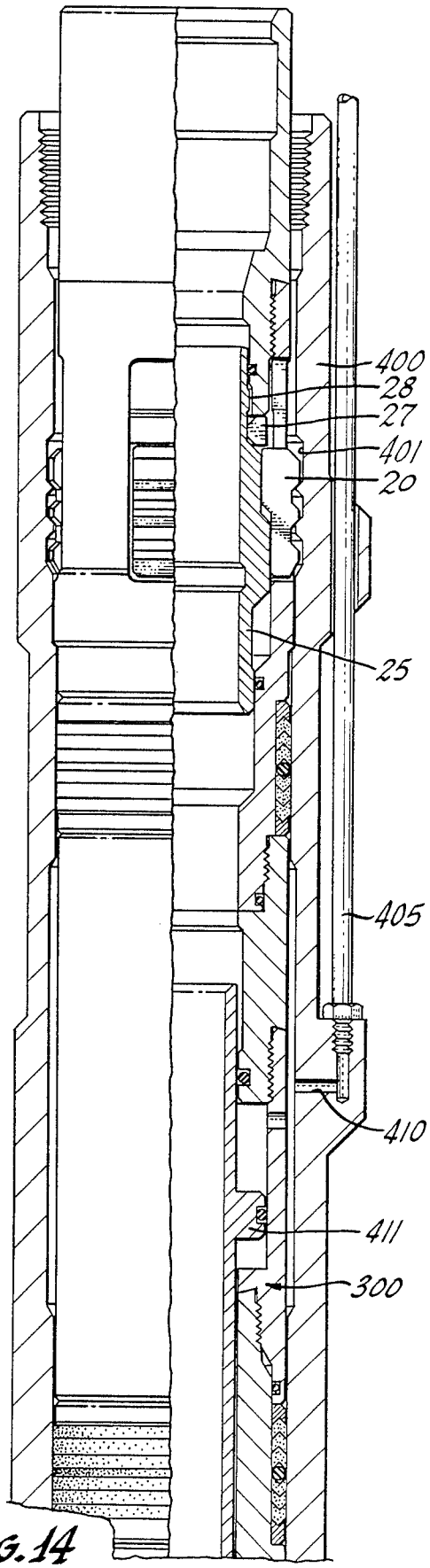
FIG. 14 is a longitudinal view in section and elevation showing the lock mandrel fully installed in the landing nipple and the running tool removed.
Figure 13A:
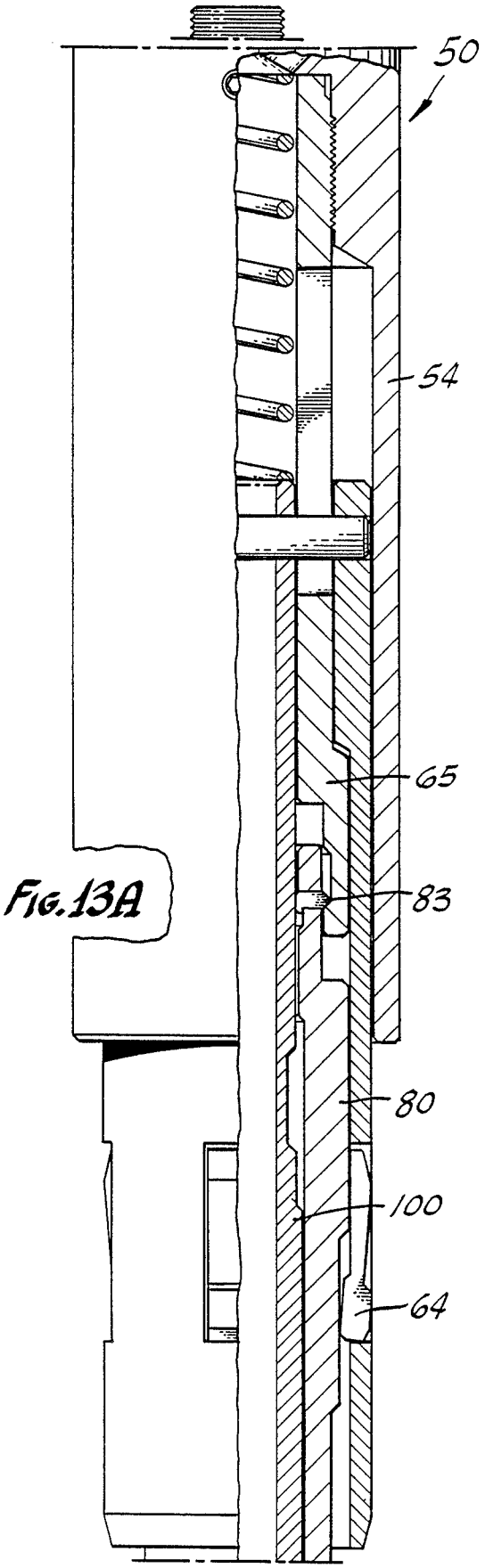
FIGS. 13A and 13B form a schematic view in section of the running tool released from the lock mandrel and being extracted from the mandrel.
Figure 13B:
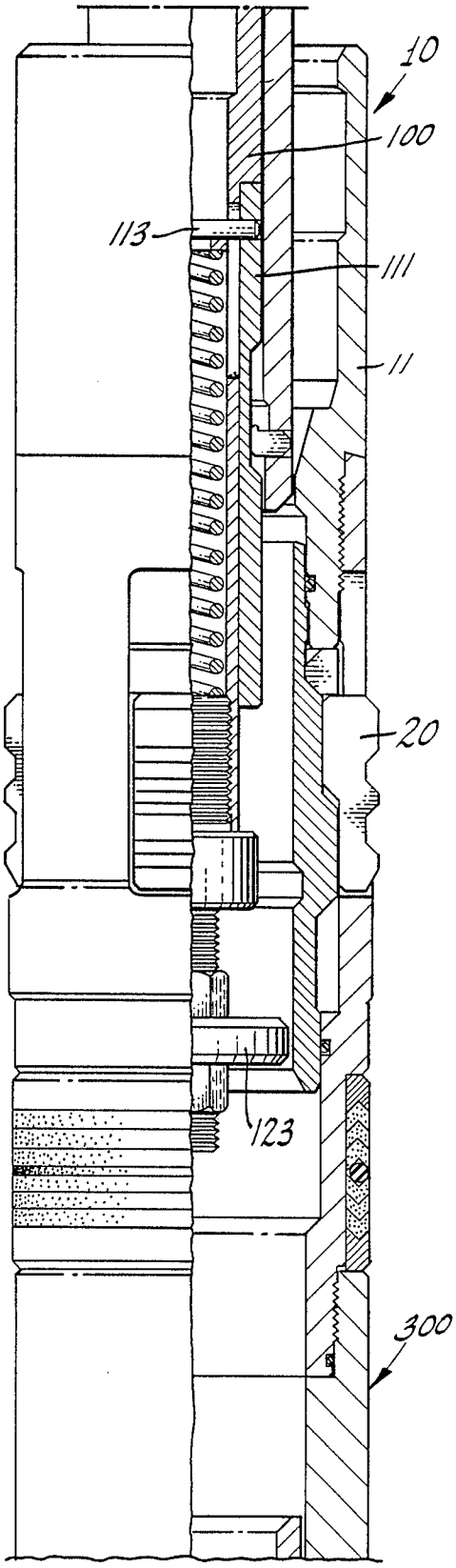

FIG. 14 shows the lock mandrel 10 in the landing nipple 400 supporting the safety valve 300 in the tubing string below the landing nipple. The lock mandrel was left in the locked condition as described and illustrated as the running tool was pulled from the mandrel, as shown in FIGS. 13A and 13B. When the locking keys 20 of the lock mandrel were fully expanded to locking positions by the upward movement of the expander sleeve 25, the expander sleeve was raised to the upper end position shown in FIG. 14 at which the locking boss 28 on the expander sleeve is above the latch ring 27, thereby, releasably holding the expander sleeve at the upper locking position.

The lock mandrel 10 and safety valve 300 may be removed from the landing nipple by the pulling tool 200 illustrated in FIGS. 15A and 15B. The pulling tool is connected on a wireline tool string and lowered into the landing nipple telescoping the tool into the lock mandrel as illustrated. The unlocking lugs 210 on the pulling tool engage the upper end edge of the expander sleeve 25 driving the sleeve 25 downwardly to the lower end position illustrated in FIG. 15B at which the locking boss 28 on the sleeve 25 is moved below the latch ring 27 and the locking dogs 20 are free to move inwardly to the unlocked position from the locking recess of the landing nipple. The pulling collet 203 on the pulling tool engages the recess 36 in the head of the lock mandrel 10 for pulling the lock mandrel back upwardly after the release of the locking dogs.

In the event, when attempting to install the safety valve and lock mandrel, the safety valve will not open when control line pressure is applied to it in the landing nipple, the wireline tool string can be jarred upwardly and the entire tool string with the lock mandrel and safety valve may be pulled back to the surface. Similarly, in the event when an attempt is made to set the lock mandrel in the landing nipple the locking dogs on the lock mandrel are not adjacent to the landing nipple locking profile, upward jarring on the tool string will retrieve the lock mandrel and safety valve to the surface. The reason that the lock mandrel and safety valve will be retrieved back to the surface with the running tool if the safety valve would not open is that in order for the running tool to lock the lock mandrel it is necessary for the upper setting sleeve to engage the transfer lugs. This cannot occur until the upward force of the safety valve on the core has been removed allowing the core to move slightly downwardly to cam the transfer lugs outwardly into the upper setting sleeve recess 74. Otherwise, pulling back upwardly on the running tool will pull the lock mandrel and safety valve back upwardly without expanding the locking lugs 20 of the lock mandrel. Similarly, if the locking lugs cannot expand outwardly the running tool will remain engaged with the lock mandrel, as the parts cannot be shifted to the relative positions for disengagement of the running tool from the lock mandrel. In such event, the tool condition will be as in FIGS. 8A and 8B, such that an upward pull on the head of the running tool will lift the upper setting sleeve 65 engaging the shoulder 62 with the internal shoulder of the retainer dog sleeve 61 pulling the dogs 64 upwardly which are engaging the recess 36 in the lock mandrel body, thus, pulling the lock mandrel upwardly.

Figure 16A:
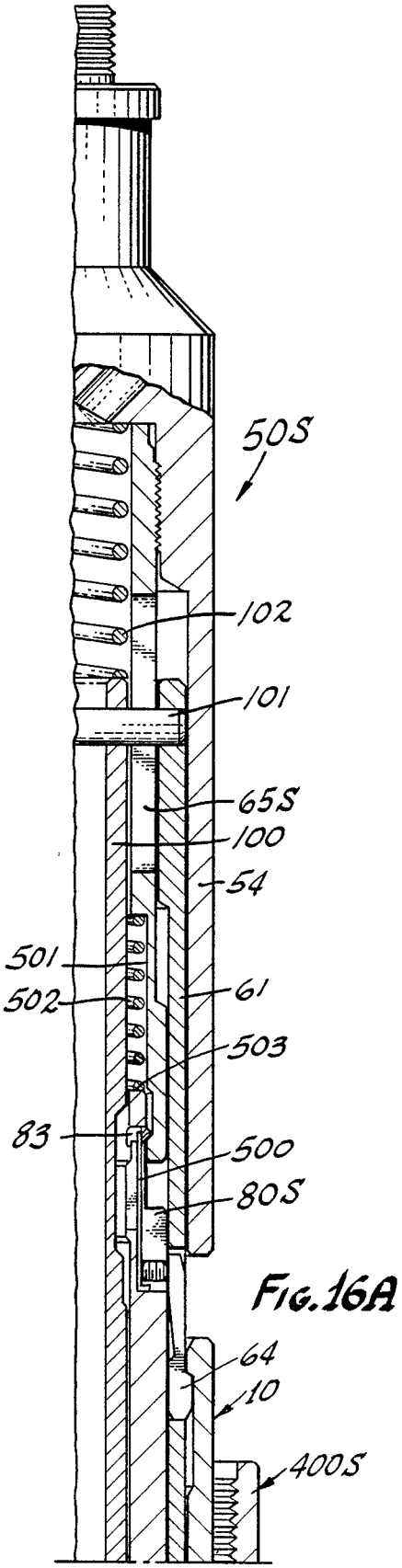
FIG. 16 is a schematic view in section and elevation of a modified form of the running tool for installation of a lock mandrel and safety valve in a staggered or graduated bore.
Figure 16B:
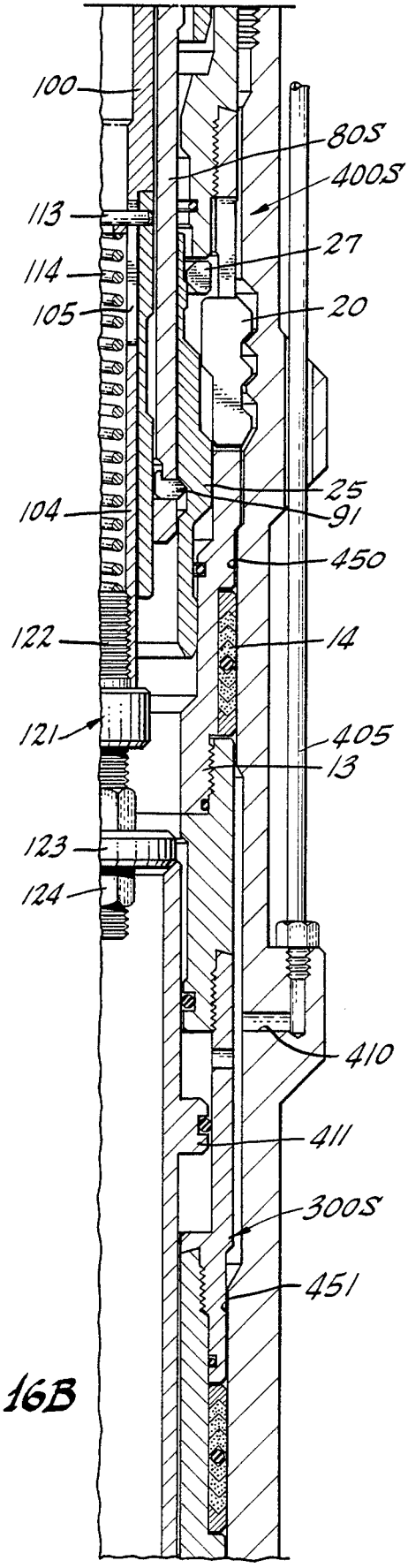

The alternate form of running tools shown in FIGS. 16A and 16B is useful only when the well bore is staggered or graduated between the landing nipple and the bore in which the safety valve is set. In such a situation, the pressure necessary to pump the safety valve open acts on a downwardly facing annular area of the safety valve and lock mandrel tending to pump the assembly back upwardly before the lock mandrel locking dogs can be set. The alternate form of the running tool shown permits the locking dogs 20 to be termporarily expanded with sufficient holding force to allow the safety valve to be pumped open without pumping the assembly back up the hole. After the temporary expansion of the locking dogs and the pumping open of the safety valve to relieve the upward force on the running tool core, the running tool may fully set the lock mandrel.

Referring to FIGS. 16A and 16B, a modified form of running tool 50S is illustrated landing and locking the lock mandrel 10 and a modified safety valve 300S in a modified staggered bore landing nipple 400S. The staggered bore landing nipple is a graduated or staged bore landing nipple having an upper bore portion 450 sized for the lock mandrel 10 and a smaller lower bore portion 451 sized for a safety valve 300S which has an outside diameter less than the diameter of the lock mandrel 10. In such a circumstance, where the lock mandrel is larger than the safety valve, there is an upward force on the lock mandrel and safety valve lifting the assembly out of the landing nipple when the safety valve is initially pressured up for the final setting stage of the lock mandrel. The effective downwardly facing area over the safety valve and lock mandrel between the line of sealing of the safety valve and the line of sealing of the lock mandrel applies the upward force lifting the tools back upwardly when the safety valve is initially pressured up to relieve the upward force of the safety valve on the core of the running tool which is necessary to effectively set the lock mandrel and release and remove the running tool. The modifications to the running tool 50S permit the running tool to initially temporarily lock the lock mandrel 10 in the landing nipple 400S while the safety valve is being pressured up preliminary to completion of the locking procedure and removal of the running tool. The temporary latching of the lock mandrel 10 is accomplished due to modified structure in the running tool which permits sufficient upward force on the running tool to temporarily set the locking dogs 20 without lifting the running tool and the lock mandrel back upwardly out of the landing nipple 400S. The modifications are in the coupling arrangement between the upper and lower setting sleeves or the running tool. The transfer lugs 83 are mounted in the upper end portion of the lower setting sleeve 80S connected with cantilever springs 500 which bias the lugs outwardly to the locking positions shown in FIG. 16A. The modified upper setting sleeve 65S has an enlarged bore portion 501 for a coil spring 502 which bears downwardly against the upper end edge surface 503 of the modified lower setting sleeve 80S of the running tool. The spring 502 biases the lower setting sleeve 80S downwardly relative to the upper setting sleeve 65S. The spring 102 is sized so that as tool string weight is removed, the spring moves the upper lead assembly including the top sub with the skirt 54 and the upper setting sleeve 65S upwardly relative to the core 100 lifting the lower setting sleeve 80S in the lock sleeve 25 to initially lock the locking dogs 20 outwardly. Thus, the sizing of the spring 102 provides sufficient upward force applied by the compressed spring to exceed the weight of the head of the running tool 50S along with the combined weights of the upper setting sleeve 65S, the lower setting sleeve 80S, the expander sleeve 25, and the related structure including the transfer lugs 83 and the locking dogs 91.

In the operation of the modified running tool 50S, to land and lock a lock mandrel 10 with a smaller safety valve 300S in the staggered bore landing nipple 400S, the running tool, lock mandrel, and safety valve are lowered through the tubing string into the landing nipple to the positions shown in FIGS. 16A and 16B. When the lock mandrel comes to rest in the landing nipple, sufficient upward force is applied to the wireline tool string to remove the weight of the tool string on the running tool. When the weight of the tool string is removed from the upper end of the running tool 50S, the spring 102 lifts the head assembly including the upper setting sleeve 65S upwardly relative to the core 100 pulling the lower setting sleeve 80S upperwardly due to the coupling of the upper and lower setting sleeves by the transfer lugs 83. The expander sleeve 25 is raised upwardly due to the coupling of the lower setting sleeve by the locking lugs 91. The expander sleeve is raised until the boss on the expander sleeve engages the ring 27 at which position the expander sleeve props the locking dogs 20 outwardly, which locks the lock mandrel 10 in the landing nipple 400S. The safety valve 300S is then pressured up through line 405 pumping the safety valve fully open to relieve the upward force of the piston 411 of the saftey valve on the running tool core. Due to the locking of the lock mandrel in the landing nipple by the dogs 20, the lock mandrel is not pumped upwardly out of the landing nipple during the pumping open of the safety valve. The core is then shifted slightly downwardly behind the transfer lugs 83 so that upward force on the tool string lifts the lower setting sleeve 80S pulling the expander sleeve 25 upwardly until latched at the upper end position by the ring 27 and the locking keys 20 are fully locked outwardly. Continued upward force then releases the running tool 50S from the lock mandrel 10 in accordance with the previous description for retrieving the wireline tool string and running tool from the well leaving the lock mandrel 10 and the safety valve 300S locked in position in the tubing string. If the setting operation has to be aborted, a pull upwardly on the tool string in excess of the force required to deflect the springs 500 through the cam surfaces of the transfer lugs 83 less the separating force applied by the spring 502 separates the upper and lower setting sleeves 65S and 80S with the spring 502 returning the lower setting sleeve to an unlocked position so that the running tool with the lock mandrel and safety valve may be pulled upwardly back out of the landing nipple. Thus, the modified form of the running tool shown in FIGS. 16A and 16B permits the normal operation of the running tool 50S when used with a safety valve which is smaller in diameter than the lock mandrel, due to the temporary latching effect while the safety valve is being pumped open.

What is claimed is:

1. A lock mandrel and running tool assembly for setting and locking a well tool in a landing nipple along a well bore comprising:

a lock mandrel having a body provided with at least one side window; a support shoulder on said body for supporting said mandrel in a no-go landing nipple; a radially movable locking dog in said side window; a longitudinally movable expander sleeve in said body movable within said dog for expanding and locking said dog outwardly and releasing said dog for inward movement, said expander sleeve having an internal annular recess for engagement by a handling tool to move said sleeve upwardly and downwardly and an external annular latch boss along an upper end portion thereof; and a latch ring in said body around said expander sleeve above said locking dog for engagement with said latch boss on said sleeve when said sleeve is at an upper locking position to releasably hold said sleeve in said upper position; and said running tool including a head assembly for connection with an operating tool string; an upper retainer dog assembly supported from said head assembly for releasably coupling said running tool with the body of said lock mandrel; a lower locking lug assembly supported from said head assembly for releasably coupling said running tool with said expander sleeve of said lock mandrel to move said expander sleeve between locking and release positions; said upper retainer dog assembly including upper and lower setting sleeves telescopically coupled together, said lower setting sleeve also comprising a component of said lower locking lug assembly and including an expandable locking lug for releasable engagement with said expander sleeve of said lock mandrel; a longitudinal core extending through said upper and lower assemblies from said head assembly coupled with said upper retainer dog assembly and having means along the lower end thereof for engagement with the operating piston of a safety valve connected with said lock mandrel for holding said safety valve open during installation, a transfer lug carried by said lower setting sleeve and operable between said upper setting sleeve and said core for releasably coupling said upper and lower setting sleeves together; an insertion sleeve on said core positioned in concentric slidable relation between said core and said lower setting sleeve, said insertion sleeve having an external annular release recess for receiving an inward portion of said locking lug, and being movable between lug locking and lug release positions on said core within said lower setting sleeve, and a spring within said core and said insertion sleeve biasing said insertion sleeve to a locking position on said core within said locking lug.

2. A lock mandrel and running tool assembly for setting and locking a well tool in a landing nipple along a well bore comprising:

a lock mandrel having a body provided with at least one side window; a support shoulder on said body for supporting said mandrel in a no-go landing nipple; a radially movable locking dog in said side window; a longitudinally movable expander sleeve in said body movable within said dog for expanding and locking said dog outwardly and releasing said dog for inward movement, said expander sleeve having an internal annular recess for engagement by a handling tool to move said sleeve upwardly and downwardly and an external annular latch boss along an upper end portion thereof; and a latch ring in said body around said expander sleeve above said locking dog for engagement with said latch boss on said sleeve when said sleeve is at an upper locking position to releasably hold said sleeve in said upper position; and said running tool including a head assembly for connection with an operating tool string; an upper retainer dog assembly supported from said head assembly for releasably coupling said running tool with the body of said lock mandrel; a lower locking lug assembly supported from said head assembly for releasably coupling said running tool with said expander sleeve of said lock mandrel to move said expander sleeve between locking and release positions; means interconnecting said upper retainer dog assembly and said lower lug assembly for initially coupling said upper retainer dog assembly with said lock mandrel body and thereafter operating said lower lug assembly to expand said locking dog on said lock mandrel to lock said lock mandrel in said landing nipple including a central, longitudinally moveable core in said running tool assembly extending from said upper retainer dog assembly to said lower lug assembly; an insertion sleeve slidably mounted on said core within said lower lug assembly for support and movement of said insertion sleeve between release and lock positions in said lower lug assembly to operate said lug assembly to couple said running tool with said lock mandrel when said lock mandrel locking dog is at a retracted release position; and spring biasing means biasing said insertion sleeve to a position for releasably locking said lower lug assembly with said expander sleeve of said lock mandrel.

3. A lock mandrel and running tool assembly in accordance with claim 2 including an adjustable core extension assembly connected with the lower end of said core for coupling said core with an operating member of a well tool supported from said lock mandrel whereby said running tool is adjustable to fit a plurality of well tool designs.

4. A lock mandrel and running tool assembly in accordance with claim 2 wherein said insertion sleeve has a release recess alignable with a locking lug of said lower lug assembly and an external locking surface alignable with said locking lug of said lower lug assembly whereby longitudinal movement of said insertion sleeve operates said locking lug of said lower lug assembly to engage and operate said lock mandrel expander sleeve and to release from said lock mandrel expander sleeve.

5. A lock, mandrel and running tool assembly in accordance with claim 4 wherein said upper retainer dog assembly includes an upper setting sleeve and a lower setting sleeve releasably connectable together for operating both said upper retainer dog assembly and said lower lug assembly, and said lower setting sleeve comprises a component of said lower lug assembly and a locking lug carried by a lower end portion of said lower setting sleeve is operable by relative movement of said lower setting sleeve and said insertion sleeve for moving said locking lug between locking and release positions relative to said expander sleeve of lock mandrel.

6. A lock mandrel and running tool assembly in accordance with claim 5 including pin means coupling said upper retainer dog assembly with said core and permitting relative longitudinal movement between said core and said upper and lower setting sleeves.

7. A lock mandrel and running tool assembly in accordance with claim 6 including spring means between said core and said operating tool head assembly for biasing said core toward said lower lug assembly away from said head assembly.

8. A lock mandrel and running tool assembly in accordance with claim 7 including a transfer lug operable between said upper and lower setting sleeves for releasably coupling said setting sleeves together.

9. A lock mandrel and running tool assembly in accordance with claim 1 including an adjustable core extension assembly secured to the lower end of said core for adapting said running tool to a plurality of different well tool designs.

10. A lock mandrel and running tool assembly in accordance with claim 1 wherein said running tool includes means for releasably expanding said locking dog of said lock mandrel to hold said lock mandrel in said landing nipple while a well tool connected with said lock mandrel is operated preliminary to final setting of said lock mandrel in said landing nipple for locking said lock mandrel in a landing nipple larger than a well bore flow conductor below said landing nipple in which said well tool is supported.

11. A running tool assembly for setting and locking a lock mandrel at a landing nipple along a well bore comprising:

said running tool including a head assembly for connection with an operating tool string; an upper retainer dog assembly supported from said head assembly for releasably coupling said running tool with the body of said lock mandrel; a lower locking lug assembly supported from said head assembly for releasably coupling said running tool with an expander sleeve of said lock mandrel to move said expander sleeve between locking and release positions; said upper retainer dog assembly including upper and lower setting sleeves telescopically coupled together, said lower setting sleeve also comprising a component of said lower locking lug assembly and including an expandable locking lug for releasable engagement with said expander sleeve of said lock mandrel; a longitudinal core extending through said upper and lower assemblies from said head assembly coupled with said upper retainer dog assembly and having means along the lower end thereof for ergagement with the operating piston of a safety valve connected with said lock mandrel for holding said safety valve open during installation, a transfer lug carried by said lower setting sleeve and operable between said upper setting sleeve and said core for releasably coupling said upper and lower setting sleeves together; an insertion sleeve on said core positioned in concentric slidable relation between said core and said lower setting sleeve, said insertion sleeve having an external annular release recess for receiving an inward portion of said locking lug, and being movable between lug locking and lug release positions on said core within said lower setting sleeve, and a spring in said core and said insertion sleeve biasing said insertion sleeve to a locking position on said core within said locking lug.

12. A running tool in accordance with claim 11 including an adjustable core extension assembly secured to the lower end of said core for adapting said running tool to a plurality of different well tool designs.

13. A running tool assembly for setting and locking a lock mandrel in a landing nipple along a well bore comprising:

a head assembly for connection with an operating tool string; an upper retainer dog assembly supported from said head assembly for releasably coupling said running tool with the body of said lock mandrel; a lower locking lug assembly supported from said head assembly for releasably coupling said running tool with an expander sleeve of said lock mandrel to move said expander sleeve between locking and release positions; means interconnecting said upper retainer dog assembly and said lower lug assembly for initially coupling said upper retainer dog assembly with said lock mandrel body and thereafter operating said lower lug assembly to expand a locking dog on said lock mandrel to lock said lock mandrel in said landing nipple including a central longitudinally moveable core in said running tool assembly extending from said upper retainer dog assembly to said lower lug assembly; an insertion sleeve slideably mounted on said core within said lower lug assembly for support and movement of said insertion sleeve between release and lock positions in said lower lug assembly for operating said lug assembly to couple said running tool with said lock mandrel when said lock mandrel locking dog is at a retracted release position; and spring means biasing said insertion sleeve to a position for releasably locking said lower lug assembly with said expander sleeve of said lock mandrel.

14. A running tool assembly in accordance with claim 13 including an adjustable core extension assembly connected with the lower end of said core for coupling said core with an operating member of a well tool supported from said lock mandrel whereby said running tool is adjustable to fit a plurality of well tool designs.

15. A running tool assembly in a cordance with claim 14 wherein said insertion sleeve has a release recess alignable with a locking lug of said lower lug assembly and an external locking surface alignable with said locking lug of said lower lug assembly whereby longitudinal movement of said insertion sleeve operates said locking lug of said lower lug assembly between lock mandrel expander sleeve operating positions and a release position from said lock mandrel expander sleeve.

16. A running tool assembly in accordance with claim 15 wherein said upper retainer dog assembly includes an upper setting sleeve and a lower setting sleeve releasably connectable together for operating both said upper retainer dog assembly and said lower lug assembly, and said lower setting sleeve comprises a component of said lower lug assembly and a locking lug carried by a lower end portion of said lower setting sleeve is operable by relative movement of said lower setting sleeve and said insertion sleeve for moving said locking lug between locking and release positions relative to said expander sleeve of said lock mandrel.

17. A running tool assembly in accordance with claim 16 including pin means coupling said upper retainer dog assembly with said core and permitting relative longitudinal movement between said core and said upper and lower setting sleeves.

18. A running tool assembly in accordance with claim 17 including spring means between said core and said operating tool head assembly for biasing said core toward said lower lug assembly away from said head assembly.

19. A running tool assembly in accordance with claim 18 including transfer lug operable between said upper and lower setting sleeves for releasably coupling said setting sleeves together.

20. A lock mandrel and running tool assembly in accordance with claim 10 wherein said means in said running tool for preliminary expanding of said locking dog includes a spring between said upper and lower setting sleeves biasing said setting sleeves apart and springs engaging said transfer lugs biasing said lugs outwardly to latching positions between said upper and lower setting sleeves.

21. A running tool assembly in accordance with claim 11 including means for initially latching said locking dogs on said lock mandrel in said landing nipple preliminary to final locking qf said locking dogs, said means comprising spring means between said upper and lower setting sleeves biasing said setting sleeves in opposite directions, and spring means associated with said transfer lug biasing said lug outwardly to a latching position between said upper and lower setting sleeves.

* * * * *